US009920520B2

(12) United States Patent
Udagawa et al.

(10) Patent No.: US 9,920,520 B2
(45) Date of Patent: Mar. 20, 2018

(54) PRIVACY SCREEN APPARATUS

(71) Applicant: Knoll, Inc., East Greenville, PA (US)

(72) Inventors: Masamichi Udagawa, New York, NY (US); Sigrid Moeslinger, New York, NY (US); Joseph A. DeLiso, Langhorne, PA (US); Adam Deskevich, Pennsburg, PA (US); James Harrison McKenzie, Perkasie, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/166,420

(22) Filed: May 27, 2016

(65) Prior Publication Data

US 2016/0348358 A1 Dec. 1, 2016

Related U.S. Application Data

(60) Provisional application No. 62/169,184, filed on Jun. 1, 2015.

(51) Int. Cl.
*A47H 23/00* (2006.01)
*E04B 2/74* (2006.01)
(Continued)

(52) U.S. Cl.
CPC ..... *E04B 2/7405* (2013.01); *A47B 97/00* (2013.01); *A47G 5/00* (2013.01); *E04H 15/62* (2013.01);
(Continued)

(58) Field of Classification Search
CPC ..... E06B 2/74; E06B 2/7401; E06B 2/7405; E04B 2002/7485; E04B 2002/7483;
(Continued)

(56) References Cited

U.S. PATENT DOCUMENTS 1,702,395 A * 2/1929 Anderson ..... E06B 9/52 160/102
1,999,398 A * 4/1935 Clarke ..... A45C 13/04 150/125
(Continued)

FOREIGN PATENT DOCUMENTS

BE 525113 A 4/1956
GB 1579622 A 11/1980

OTHER PUBLICATIONS

International Search Report for PCT/US2016/034952 dated Sep. 9, 2016.
(Continued)

*Primary Examiner* — Katherine W Mitchell
*Assistant Examiner* — Jeremy C Ramsey
(74) *Attorney, Agent, or Firm* — Buchanan Ingersoll & Rooney PC

(57) ABSTRACT

A privacy screen apparatus can include a body having a plurality of elongated recesses and between elongated pillow regions. The pillow regions can have a larger width than the recesses. In some embodiments, the body can be configured to bend about the elongated recesses to different configurations. A plurality of stand elements can be connected to the bottom of the body to permit the body to be free standing. In other embodiments, a plurality of connectors can be connected to the body for connecting the body to an article of furniture, such as a tabletop or a desktop.

17 Claims, 15 Drawing Sheets

(51) Int. Cl.
*A47G 5/00* (2006.01)
*A47B 97/00* (2006.01)
*E04H 15/62* (2006.01)
*E04H 1/12* (2006.01)

(52) U.S. Cl.
CPC ... *A47B 2200/12* (2013.01); *E04B 2002/7483* (2013.01); *E04H 1/1272* (2013.01)

(58) Field of Classification Search
CPC ..... A47B 97/00; A47B 2200/0071; A47B 2200/0085; A47B 2200/0068; E04H 1/1272
USPC ..... 248/200, 213–215; 52/220.7, 52/236.9–243.1; 160/351, 350, 377, 391, 160/402, 127; 428/113; 108/157.18, 108/159, 158.13, 153.1, 27; 256/23, 24, 256/59
See application file for complete search history.

(56) References Cited

U.S. PATENT DOCUMENTS 2,755,484 A * 7/1956 Hotz ..... E04H 4/142 160/330
2,942,924 A * 6/1960 Stangert ..... A47B 21/03 108/27
2,981,583 A * 4/1961 Eisenberg ..... A47F 3/142 269/97
3,748,006 A * 7/1973 Levit ..... F16B 12/28 223/66
3,950,906 A * 4/1976 Mollinger ..... E04B 2/96 52/222
4,118,903 A * 10/1978 Coulthard ..... A47B 57/26 108/152
4,821,787 A * 4/1989 Swanson ..... A47G 5/00 160/135
5,287,909 A 2/1994 King et al.
5,609,112 A * 3/1997 Meyer ..... A47B 17/00 108/158.13
5,657,808 A * 8/1997 Lin ..... A47H 13/00 160/330
5,675,946 A 10/1997 Verbeek et al.
5,680,893 A 10/1997 Neer
5,890,782 A * 4/1999 Alberts ..... A47B 17/00 108/27
5,966,879 A 10/1999 Verbeek
D427,783 S 7/2000 Luedke
D457,359 S 5/2002 Chan
D458,040 S 6/2002 Stannis et al.
6,896,028 B2 5/2005 Brennan
7,140,134 B1 * 11/2006 Flagg ..... G09F 7/18 108/152
7,789,025 B2 9/2010 Michaud, II et al.
D653,862 S 2/2012 Hairston
8,365,798 B2 2/2013 Feldpausch et al.
2002/0062933 A1 * 5/2002 Insalaco ..... A47G 5/00 160/351
2002/0132543 A1 * 9/2002 Baer ..... A47K 10/42 442/327
2005/0076585 A1 * 4/2005 Kelly ..... E04B 2/7429 52/144
2008/0216974 A1 * 9/2008 Pitcher ..... G09F 7/18 160/330
2010/0196686 A1 * 8/2010 Van Dam ..... B32B 5/14 428/219
2013/0304441 A1 11/2013 Fricke
2015/0259897 A1 * 9/2015 Carroll ..... E04H 1/00 52/582.1

OTHER PUBLICATIONS

Written Opinion of the International Searching Authority for PCT/US2016/034952 dated Sep. 9, 2016.

* cited by examiner

PRIVACY SCREEN APPARATUS

CROSS-REFERENCE TO RELATED APPLICATIONS

The present application claims priority to U.S. Provisional Patent Application No. 62/169,184, which was filed on Jun. 1, 2015.

FIELD OF INVENTION

The present innovation relates to furniture such as privacy screen devices.

BACKGROUND OF THE INVENTION

Privacy screens can be utilized to provide a visible barrier in a workplace setting or other setting. Examples of privacy screens can be appreciated from U.S. Pat. Nos. 8,365,798, 7,789,025, 6,896,028, 5,966,879, 5,675,946, 5,680,893, and 5,287,909, U.S. Design Pat. Nos. D653,862, D458,040, D457,359, and D427,783 and U.S. Patent Application Publication No. 2012/0304441.

SUMMARY OF THE INVENTION

A privacy screen apparatus is provided. In some embodiments, the privacy screen apparatus may be configured to be free standing on a desktop or floor while also being configured to be moveable into different configurations (e.g. positions or orientations) by a user who may adjust how the privacy screen apparatus is shaped or otherwise positioned. In other embodiments, a privacy screen apparatus can be configured to be attached to a desktop or tabletop for providing a visible barrier along at least a portion of a perimeter of such a work surface.

A privacy screen apparatus is provided that can include a first body that is configured to be attached to an article of furniture adjacent to a work surface or to be free standing on a floor or work surface. The first body can have a plurality of spaced apart pillow regions and a plurality of spaced apart recess regions. Each recess region spaces apart immediately adjacent pillow regions. The pillow regions can be configured to have a thickness that is greater than a thickness of the recess regions.

The privacy apparatus can include a plurality of stand elements connected to a lower portion of the first body so that the first body is free standing on the floor or the work surface. Each stand element can have at least one slot sized to receive a portion of the lower portion of the first body. For instance, the at least one slot of each stand element can include a first slot that is transverse to a second slot. The second slot can be in communication with the first slot and having a width that is greater than the width of the first slot such that the second slot is configured to retain a portion of the first body and a portion of a second body. The second body can have a plurality of spaced apart pillow regions and a plurality of spaced apart recess regions such that each recess region spaces apart immediately adjacent pillow regions. The pillow regions can each have a thickness that is greater than a thickness of the recess regions.

The first body and/or the second body can be comprised of an elastomeric material and can be formed to have a non-woven appearance. For instance, the first body and/or the second body can be formed by a plurality of elongated elastomeric fibers being bonded together to provide the non-woven appearance. In some embodiments, the first body and/or the second body can be formed by a plurality of elongated elastomeric fibers being bonded together such that the first body has a density of material of between 0.055 grams/cm$^3$ and 0.090 g/cm$^3$. Diameters of the elongated elastomeric fibers can be between 0.40 mm and 0.70 mm (or between 0.40 mm and 0.50 mm) in such embodiments. In some embodiments, the first body and/or the second body can be covered by a fabric. Each fabric covering may cover the entirety of the body to which it is attached or may cover a substantial portion of that body (e.g. front and rear faces of the body and parts of the sides of the body, etc.).

Embodiments of the privacy screen apparatus can include a plurality of connectors attached to a lower portion of the first body to attach the first body adjacent to a work surface. For example, each of the connectors can have a bracket, at least one first member extending from a first side of the bracket, and at least one second member extending from a second side of the bracket that is opposite the first side of the bracket. A vertically extending portion of each first member can extend vertically parallel to a vertically extending portion of a corresponding second member to define an opening for receiving a portion of the lower portion of the first body. The vertically extending portion of the first member can be configured to move away from the vertically extending portion of the corresponding second member to receive the first body and can be configured to be resilient for being biased to move toward the vertically extending portion of the corresponding second member to grasp the portion of the lower portion of the body received in the opening. As another example, each connector can have a clamping member that is moveable relative to a connecting member to receive and retain the lower portion of the first body. At least one threaded member can extend from the clamping member to the connecting member. A portion of the threaded member can pass through the first body positioned between the clamping member and the connecting member. A rotating connecting element that can be rotatably connected to the threaded member to be rotated to adjust a distance between the clamping member and the connecting member.

In other embodiments, each of the connectors can include a J-shaped member having a first upper end that is positionable adjacent an outer face of the first body and a second end opposite the first upper end that is positionable within a lower opening of a bracket assembly for attachment to the work surface. In yet other embodiments, each of the connectors can include an elongated member that is configured to extend linearly from adjacent the edge of the work surface to adjacent a top edge of the first body. An upper end of the elongated member having an opening that is in communication with a slit to receive and retain the top edge of the first body within the opening such that a portion of the first body extends downwardly from the opening and through the slit.

The first body and/or the second body can be configurable to multiple different orientations via bending or flexing of the body along at least some of the recess regions. The pillow regions can be stiffer than the recess regions. The orientations of the body comprise at least two of (or all of): a linearly extending orientation, a generally "U" shaped orientation, a generally "V" shaped orientation, a generally "C" shaped orientation, a generally "S" shaped orientation, a generally "O" shaped orientation, and a generally "L" shaped orientation.

A method of making a privacy screen apparatus is also provided. The method can include the steps of forming elongated fibers from an elastomeric material such that diameters of the elongated elastomeric fibers can be between 0.40 mm and 0.50 mm, 0.40 mm to 0.70 mm, or 0.35 mm and 0.75 mm. The method can also include the steps of randomly laying the formed elongated fibers on top of each other, bonding the elongated fibers that are randomly laid on top of each other, forming a first body from the bonded elongated fibers such that the first body has a density of material of between 0.055 grams/cm$^3$ and 0.090 g/cm$^3$ or 0.55 grams/cm$^3$ and 0.075 grams/cm$^3$. The first body may be formed such that the first body is formed to have a plurality of spaced apart pillow regions and a plurality of spaced apart recess regions, each recess region spacing apart immediately adjacent pillow regions where the pillow regions have a thickness that is greater than a thickness of the recess regions, and providing stand elements or connectors that are sized and configured to be attached to lower portions of the first body. Embodiments of the method can also include other steps. For instance, the method can also include the step of attaching the first body to an article of furniture adjacent to a work surface via the connectors or can include the step of positioning the first body in the stand elements to support the first body on a floor or work surface.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of privacy screen apparatuses are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
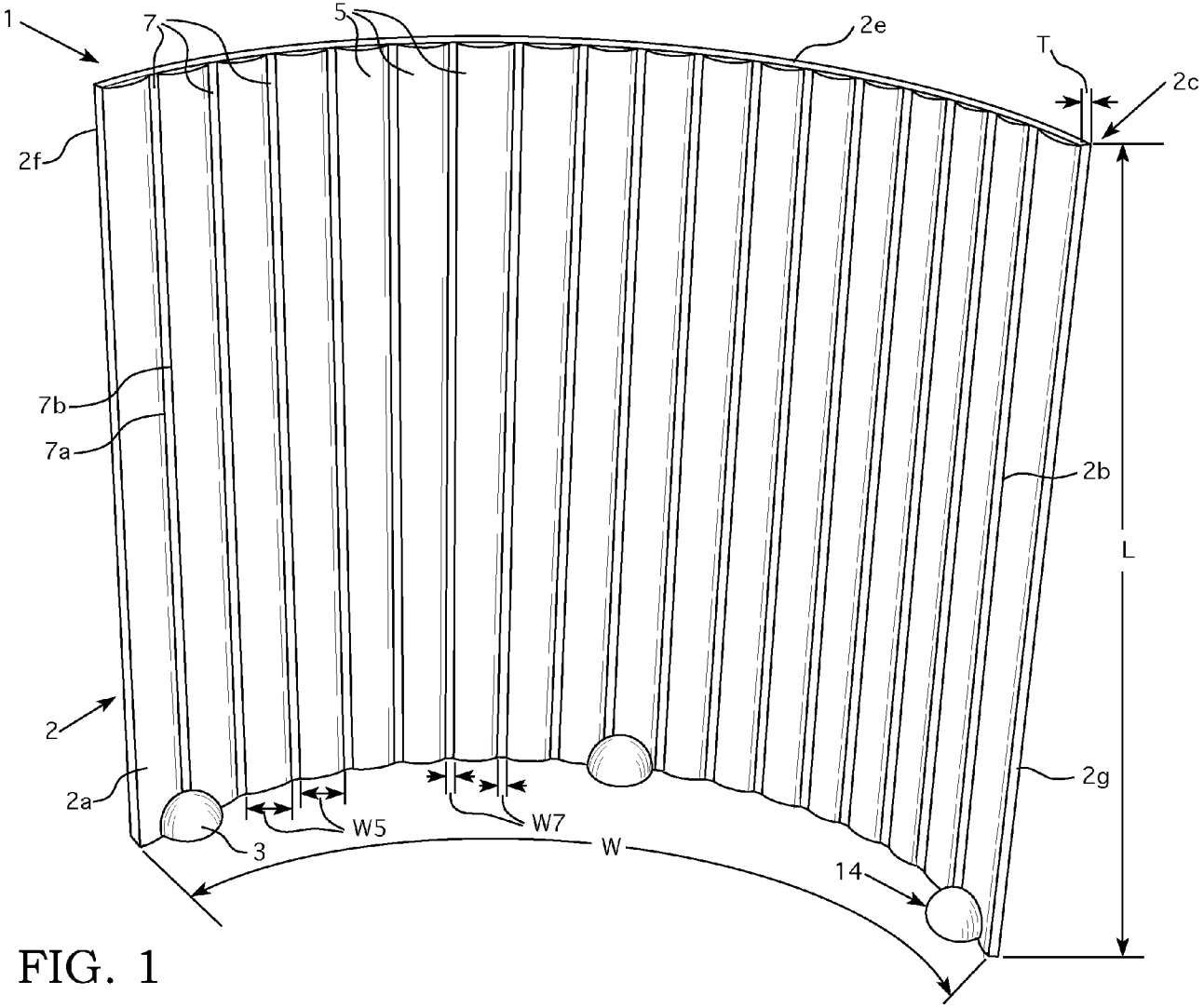
FIG. 1 is a perspective view of a first exemplary embodiment of a privacy screen apparatus.
Figure 2:
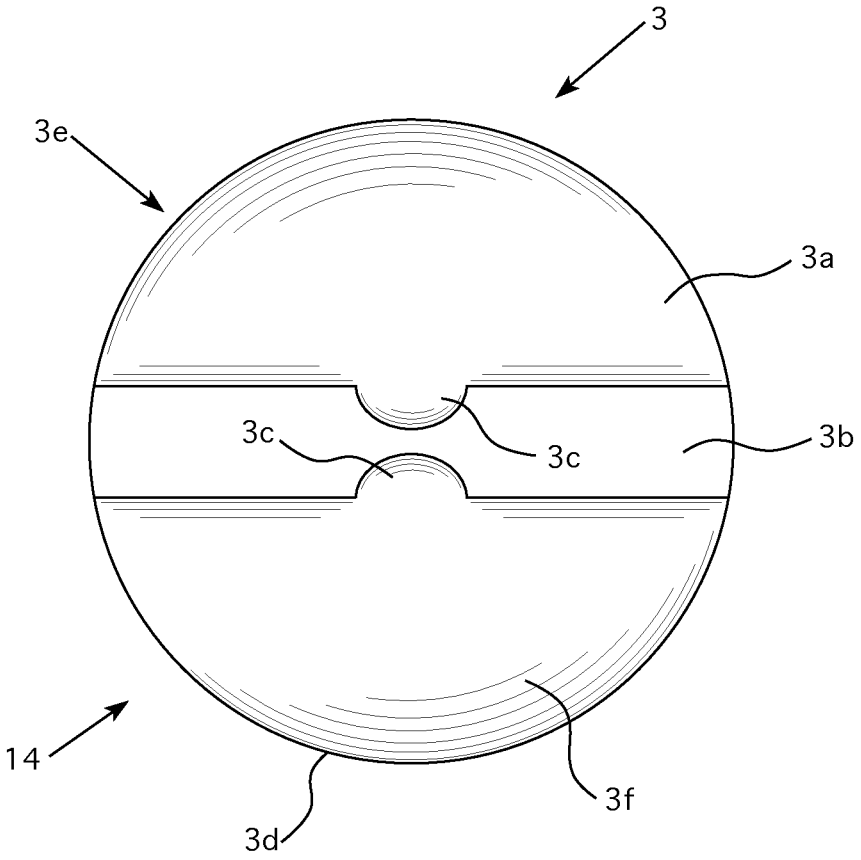
FIG. 2 is a top perspective view of a stand element of the first exemplary embodiment of a privacy screen apparatus.

Referring to FIGS. 1-15, a privacy screen apparatus can include a body 2 that has a bottom edge attached to a plurality of stand elements 14 (e.g. stand elements 3 or 41) so that the body can be free standing on a work surface such as a floor, a countertop, a desktop, or a tabletop. The body can alternatively be attached to one or more connectors 12 (e.g. grasping connector 13 or clamping connector 23) for being connected to at least one peripheral edge of a desktop, tabletop, or countertop, or other work surface.

The body 2 can be composed of an ethylene vinyl acetate (EVA) and polyethylene (PE) foam (e.g. an EVA+PE foam). In some embodiments, the foam body may have a covering 2*a* that is on the entire exterior of the foam or that is on a substantial portion of the exterior surface of the polyethylene foam body (e.g. covers 70% or more of the exterior surface, 80% or more of the exterior surface, 90% or more of the exterior surface, etc.). For instance, the covering 2*a* may be a fabric covering 2*a* that is positioned over the entirety of the external surface of the foam or over a substantial portion of the exterior surface of the foam. In yet other embodiments, the body may not have any covering and/or may be composed of another type of material (e.g. a film). For instance, in some embodiments the body 2 can be composed of an elastomeric material such as, for example, a thermoplastic elastomer (TPE) such as a thermoplastic polyester elastomer, a thermoplastic copolyester elastomer (TPC-ET), a polyether-ester block copolymer, styrenic block copolymers (TPE-s), a polyolefin blend (TPE-o), elastomeric alloy (TPE-v or TPV), a thermoplastic polyurethane (TPU), a thermoplastic copolyester, or a thermoplastic polyamide or may be composed of another type of elastomeric material. For instance, a body 2 can be composed of a thermoplastic copolyester elastomer that is sold under the Hytrel brand name by E. I. du Pont de Nemours and Company and/or its affiliates.

In some embodiments, the body 2 can be composed of an elastomeric material and have a non-woven appearance. For instance, as can be appreciated from FIGS. 13-14, an embodiment of the body 2 can be configured to not include a cover and be composed of an elastomeric material that has a non-woven appearance. While a covering may not be positioned on the elastomeric body 2 having a non-woven appearance, it is also possible that a covering could be positioned on such a body. The covering 2*a* could be a film, a fabric covering or other type of covering. For such embodiments that utilize a covering, the covering can be attached to cover the entirety of the exterior surface of the body 2, a substantial portion of the exterior surface of the body 2, or just discrete portions of the exterior surface of the body 2 for providing a desired aesthetic effect.

Figure 14:
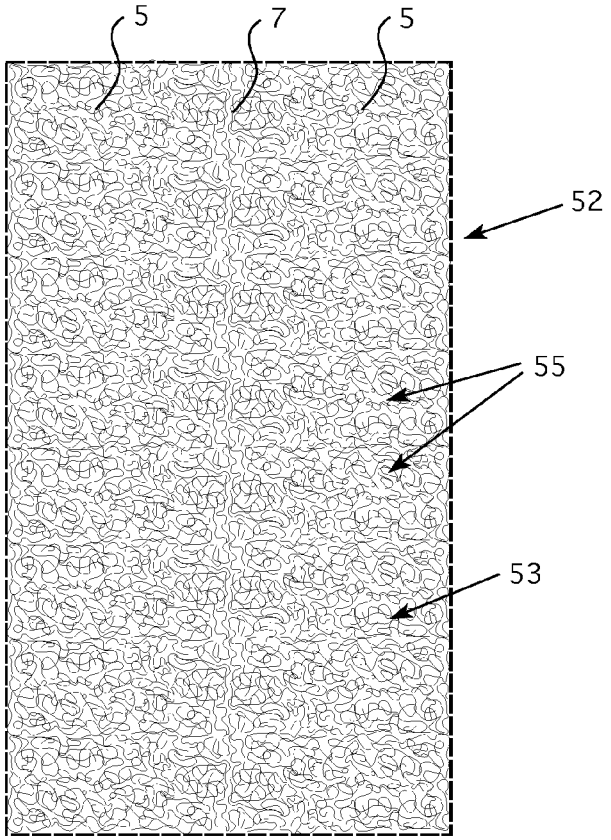
FIG. 14 is an enlarged view of a portion of the exemplary body 2 illustrated in FIG. 13.
Figure 15:
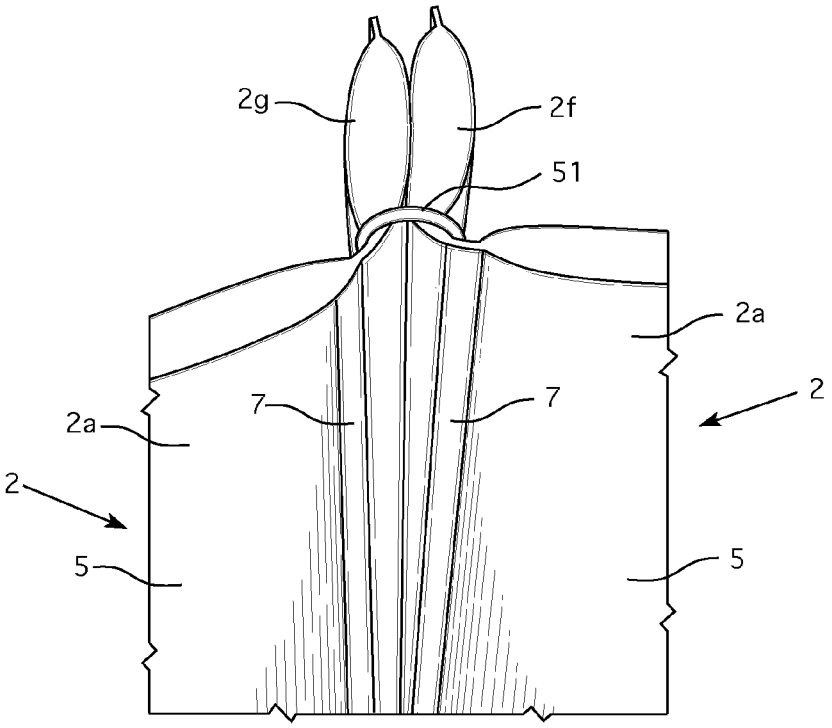
FIG. 15 is an enlarged perspective view of a portion of the third exemplary embodiment of a privacy screen apparatus shown in FIG. 9.

The non-woven appearance of the body 2 can be provided by the body 2 being formed by long fibers 55 of elastomeric material being laid on top of each other and being bonded together by chemical, mechanical, heat and/or solvent treatment. For instance, in some embodiments the fibers may be bonded together via vibration welding or other type of bonding process. The elongated fibers may be made via extrusion or other process and subsequently laid on top of each other in a relatively random arrangement 53 having a plurality of apertures defined by the randomly arranged fibers 55 prior to being bonded together to form the body. An enlarged view of segment 52 of the body 2 is illustrated in FIG. 14 to provide a more clear view of an example of such a non-woven appearance.

The body 2 formed to have a non-woven appearance may then be placed into a press mold that applies pressure and heat to the body 2 to define the recess regions 7 and the pillow regions 5 via an application of compression and heat at the recess regions 7 to define those regions. First, second, third, and fourth edges 50*a*, 50*b*, 50*c*, and 50*d* of the body 2 can also be of a thickness that is thinner than the pillow regions 5 to define a border 50 along the outer periphery of the body 2 that is thinner than at least the pillow regions 5 (e.g. border 50 has the same thickness of the recess regions or of a different thickness that is less than the thickness of the pillow regions 5). In some embodiments, the border 50 can be formed by a press mold applying pressure and heat (e.g. application of compression and heat) along the edges of the body 2.

In some embodiments, the pillow regions 5 may also undergo some heating or pressure via a mold. But, the pillow regions may not undergo as much compression and/or heat such that those pillow regions 5 are thicker than the border 50 and the recess regions 7 and have a non-woven appearance with filaments being spaced apart to a greater degree than the filament portions that form the recess regions 7 and border 50. In other embodiments, it is contemplated that the use of the mold to form the border 50 and/or recess regions 7 may be conducted such that the pillow regions 5 do not undergo any heating or any compression.

In some embodiments, the diameter of the elastomeric filaments or elastomeric fibers may be between 0.40-0.50 mm or between 0.40-0.70 mm or between 0.35-0.75 mm in some embodiment (e.g the width may be 0.40-0.50 mm, 0.4-0.7 mm, or 0.35-0.75 mm). In other embodiments, the filament diameter (or fiber diameter) may be between 0.42-0.46 mm. Of course, in other embodiments, the filaments (or fibers) may have other diameters and the length of the filaments (or fibers) may be any suitable length. The size and shape of the filaments (or fibers) may be configured to provide a pre-selected density of material for the body 2. For instance, the diameter or width of the filaments can affect the density. A decrease in the diameter of the filaments may result in an increase in material density and the increase of the filament diameter may result in a decrease of the material density. For instance, the density of the body 2 for providing the non-woven appearance of the body 2 may be at a pre-selected value or range such as, for example, 0.065 grams/cm$^3$ or within 15% of this density value or such that the body has a material density of between 0.055 grams/cm$^3$ and 0.075 grams/cm$^3$. For some embodiments, the filaments may be sized and configures so that the body formed of the filaments has a material density of more than 0.055 grams/cm$^3$ or is within a different range, such as a material density of between 0.055 grams/cm$^3$ and 0.090 g/cm$^3$, a material density of between 0.060 grams/cm$^3$ and 0.095 grams/cm$^3$, or a material density of between 0.060 grams/cm$^3$ and 0.088 grams/cm$^3$. Other embodiments may utilize other densities.

In some embodiments of the body 2, the border 50 may include more than four edges or less than four edges. For instance, if the body is circular in shape it may just have a border defined by one continuous outer edge of the body. As another example, if the body has more than four sides (e.g. is hexagonal in shape) or less than four sides (e.g. is triangular in shape), the border may be defined by more than four or less than four edges to provide a peripheral border for the body. The interior shape of the body may have the same profile (e.g. use of pillows and recessed regions) or have another type of configuration for such embodiments.

The body 2 can be structured so that the body has a length L, a width W, and a thickness T. In some embodiments, the length L can be considered a height and the thickness T can be considered a depth of the body 2.

The thickness T of the body 2 may vary throughout the length L and width W of the body 2. The variable thickness may change along discreet sections of the body as the body extends along its length L and width W. For instance, pillow regions 5 of the body 2 may be thicker than recess regions 7 of the body 2 and may also be stiffer than the recess regions 7 of the body 2. The thickness of each pillow region 5 may be a uniform thickness and the thickness of each recess region may be a uniform thickness. In some embodiments, a lip can be defined at the first side 7*a* of each recess region by a side of a first pillow region 5 that defines that first side 7*a* and a lip can be defined at the second side 7*b* of each recess region by a second pillow region 5 that is immediately adjacent to the first pillow region 5 that is located at that second side 7*b* of the recess. The lips can define the interface region between the recess region 7 and the pillow regions 5 that define that recess region 7. In some embodiments, the lips may extend linearly or may be configured to extend about a curve.

The pillow regions 5 and recess regions 7 may be defined on a first face 2*b* and an opposite second face 2*c* of the body 2. The first face 2*b* and second face 2*c* may extend between a first bottom edge 2*d* and a second top edge 2*e* of the body 2 and may also extend between a third side edge 2*f* and a fourth side edge 2*g* of the body 2. The first face 2*b* may face a direction that is opposite the direction of the second face 2*c*. For instance, in some embodiments, the first face 2*b* may face forwardly (e.g. be a front face) and the second face 2*c* may face rearwardly (e.g. be a rear face). In other embodiments, the faces may be curved or angled so that each face has different corresponding regions that face outwardly at opposite directions.

The body 2 can be structure so that there are a plurality of spaced apart recess regions 7 that each have an elongated recess such as, for example, a trench, a groove, a furrow, a channel, or other type of recess defined between immediately adjacent pillow regions 5. Immediately adjacent pillow regions 5 may be spaced apart from each other by a respective one of the recess regions 7.

The pillow regions 5 may be regions of the body 2 that are thicker than the recess regions 7 having the recesses defined therein. The pillow regions may have a length that is equal to the length L of the body 2 or is substantially equal to the length L of the body (e.g. within 90% of the length L of the body 2, within 95% of the length L of the body 2, etc.). The width W5 of each pillow region 5 may be greater than the width W7 of each recess region 7, while the lengths of the pillow regions 5 may be equal to or substantially equal to the length L of the recesses 7 (e.g. within 10% of the lengths of the pillow regions, within 5% of the lengths of the pillow regions, equal to the lengths of the pillow regions etc.) The thicknesses of the pillow regions 5 may be greater than the thicknesses of the recess regions of the body 2.

The recess regions 7 can be defined to provide flexibility in the body 2. For instance, the defined recess regions 7, which are thinner than the pillow regions 5, can allow the body 2 to be curved or otherwise configured by a user so that the body bends about the length of the recess regions. The stiffer pillow regions may not bend, or may bend substantially less than the recess regions 7 such that the bending or multiple configurability of the body 2 is primarily provided by the recess regions 7 defined in the body 2. The bendability of the body 2 can allow the body 2 to be moved into multiple different configurations. For instance, the body can be positioned in a linear or planar position and subsequently moved into a bowed or curved position by a user providing a force on the body 2. Stand elements 14 (e.g. stand elements 3 or 41) can be attached to the bottom edge 2*d* of the body 2 to help maintain the body 2 in such a configuration when the body 2 is placed on a work surface such as a floor, a tabletop, or a desktop.

In some embodiments, the stand elements 14 may also be configured to be moveable along the bottom edge 2*d* of the body to adjust the location of the stand elements 14 for changing the configuration of the body 2. For instance, stand elements 3 can be configured so that they may be slid along the bottom edge 2*d* of the body 2 to different positions so that the body 2 may be moved from a first position in which it is linearly extending to a second position in which it is curved and may be further slid to adjust the position of the body to a third position in which the body is then further curved or less curved as compared to the second position. In some embodiments, it is contemplated that the body 2 may be flexible via the recess regions 7 such that the body 2 is configurable from a linearly extending position (e.g. a straight or planar position) to curved position in which the body 2 has a generally "U" shaped orientation (e.g. the body has the shape of a "U" in such a configuration), "V" shaped orientation (e.g. the body 2 is shaped like a "V" in such a configuration), or "C" shaped orientation (e.g. the body 2 is shaped like a "C" in such a configuration), to a third configuration in which the body has a generally "S" shaped orientation (e.g. the body is shaped like an "S" in such a configuration) to a fourth configuration in which the body has a generally "O" shape (e.g. the body is shaped like an "O" in such a configuration), to a fifth configuration in which the body 2 has a generally "L" shaped orientation (e.g. the body is shaped like an "L" in such a configuration).

In some embodiments, such as the embodiment shown in FIGS. 1-2 and 16-17, a privacy screen apparatus 1 can include stand elements 3 that have a hemispherical body (e.g. a generally half-spherical body) that has a top side 3*e* and a bottom side 3*d*. The stand elements 3 can be composed of any type of suitable material, such as, for example, brass, zinc, another type of metal, a composite material, a polymeric material, or a combination of such materials. The bottom side 3*d* may be flat or substantially flat and be configured to contact a work surface such as a floor, a desktop, countertop, a tabletop, or other work surface. The bottom surface of the bottom side that contacts a floor or work surface may have an anti-skid film, or a profile that is configured to prevent skidding or sliding of the stand element 3 when it is positioned on a work surface or floor.

The top side 3*e* can be configured to have a body receiving slot 3*b* that is defined between a first upper portion 3*a* and a second upper portion 3*f*. The slot 3*b* can be defined between the first and second upper portions. The first and second upper portions 3*a* and 3*f* may each have a projection 3*c*. The projections 3*c* can be positioned to correspond with each other and to extend towards each other at the top of each upper portion so that the projections 3*c* extend toward each other to make the width of the slot 3*b* smaller adjacent the location of the projections 3*c*. The slot 3*b* can be sized to receive a bottom portion of the body and the projections 3*c* can be configured such that they are moveable away from each other to allow the bottom portion of the body to be positioned in the slot. The projections 3*c* can also be configured so that their movement away from each other for receiving the body also results in the projections 3*c* being resiliently biased to move toward each other to help facilitate grabbing or holding of the bottom portion of the body within the slot 3*b* to help retain the body 2 in the slot 3*b*.

Figure 16:
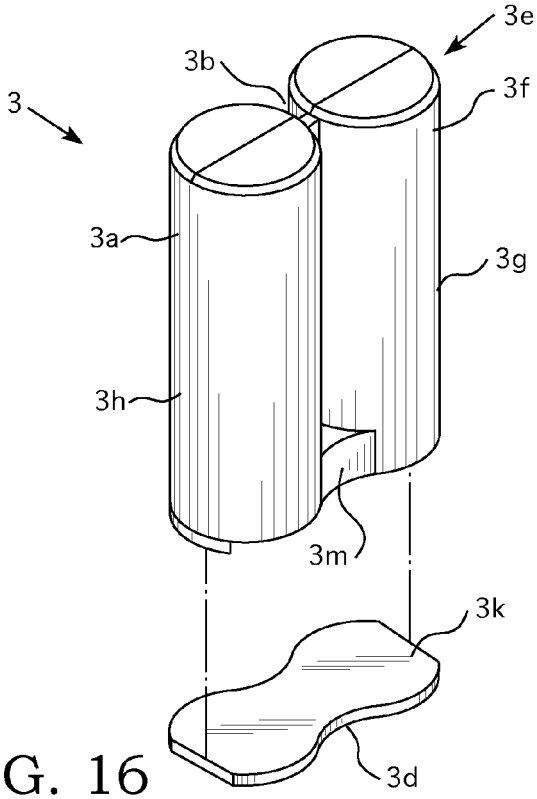
FIG. 16 is an exploded view of an exemplary embodiment of a stand element that is utilizable with the first exemplary embodiment of the privacy screen apparatus.
Figure 17:
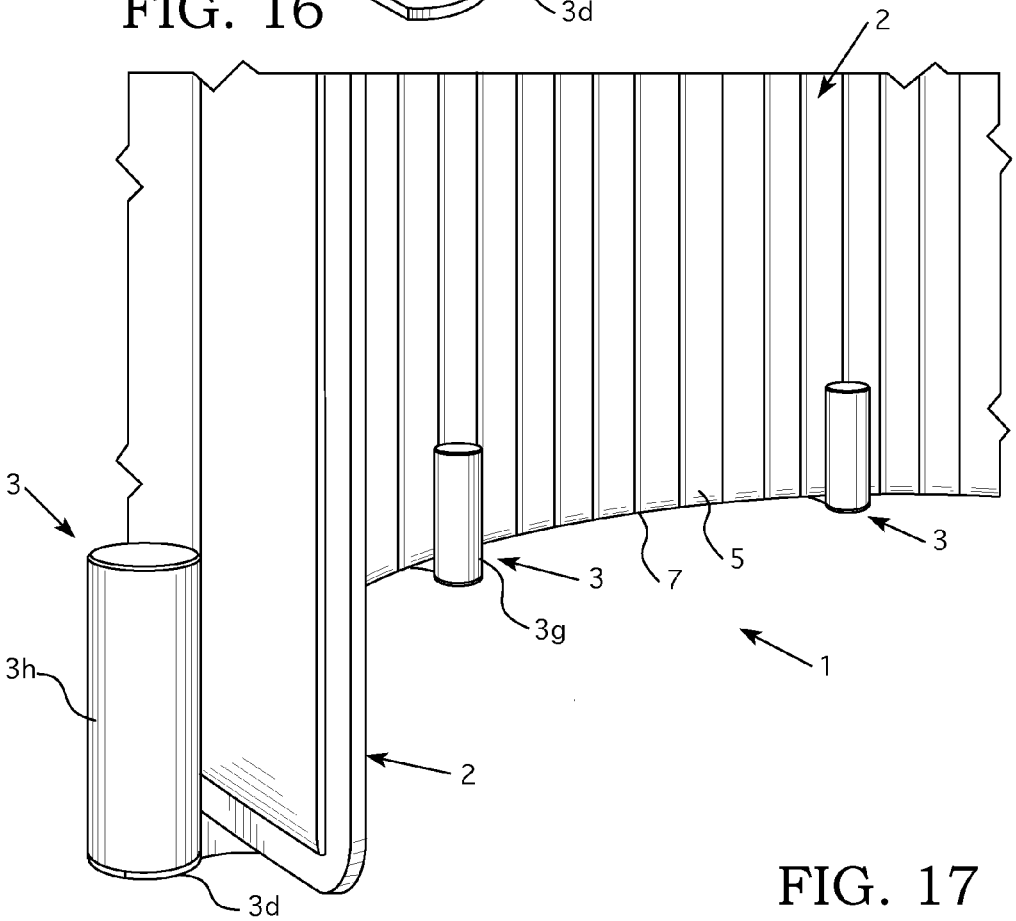
FIG. 17 is perspective view of the first exemplary embodiment of the privacy screen apparatus utilizing the stand elements shown in FIG. 16.

In other embodiments of the privacy screen apparatus, the stand elements 3 may be configured to not have any projections for grabbing or otherwise helping to retain a portion of the body 2. For example, as shown in FIGS. 16-17, stand elements 3 can be configured so that the slot b is more elongated via longer upper sections to receive and hold the body 2. As shown in FIGS. 16-17, such stand elements may include spaced apart first and second projections 3*g* and 3*h* that extend from a base element 3*k* to define the body receiving slot 3*b*. The first and second projections 3*h* and 3*g* may be attached together adjacent a bottom end of the projections to help define a bottom 3*m* of the slot 3*b*. In some embodiments, the projections and base 3*k* may be a unitary member and in other embodiments the projections may be attached to the base element 3*k* via adhesive, welding, interlocking profiles, or other fastener mechanism or combination of such mechanisms. The first and second projections 3*g* and 3*h* may be shaped to be cylindrical shaped projections as shown in FIGS. 16 and 17 or may structure to have another type of shape, such as a polygonal shape, a box shape, a tubular shape, or other type of projection shape for the projections to extend vertically upwardly from the base element 3*k* to the top side of the stand element 3.

As another example, embodiments of the privacy screen apparatus can include stand elements 41 as shown in FIGS. 9-12. In other embodiments, a stand element may be configured to be of a pre-selected weight to help keep a body 2 supported in a desired orientation as well.

Stand elements 41 can be configured to include an upper portion 41*e* and a bottom portion 41*d*. Such stand elements 41 can have any desired shape, such as a rectangular shape, cylindrical type shape, or other type of shape and may be composed of any suitable material. The stand elements may have a height H (which could also be considered a length) and a width, which can also be considered a diameter D for circular cross-section shaped embodiments such as cylindrically shaped embodiments.

The bottom portion 41*d* of the stand element 41 may have a flat bottom surface and include a weighted element to help provide weight to allow the stand to provide a sufficient amount of support to a body portion attached or otherwise received and held by that stand element 41. The weighted element may be, for example, a metal disc or other type of metal weight element (e.g. a steel disc, a lead disc, a lead body, a zinc body, a zinc disc, a steel body, etc.) or other type of weight element (e.g. a vessel holding sand or water that is included in the bottom portion 41*d* of the stand element 41). The bottom surface of the bottom portion 41*d* may have a skid resistant surface or an anti-skid profile for contacting a floor.

The top portion 41*e* may have a first slot 41*b* that extends along the entire width or diameter D of the upper portion and a second slot 41*a* that extends from the first slot to a peripheral side of the top portion (e.g. along a radius of the top portion, along a portion of the diameter D of the top portion, or along a portion of the width of the top portion). The first slot 41*b* and the second slot 41*a* may be positioned transverse to each other. For instance, the second slot 41*a* may extend away from the first slot 41*b* such that the second slot 41*a* is perpendicular or substantially perpendicular to the first slot 41*b* (e.g. within 10° of being perpendicular, within 5° of being perpendicular, within 2° of being perpendicular, etc.).

The top portion 41*e* can include a first element 41*c* that defines a side of the first slot 41*b*, a second element 41*f* that defines a portion of the second side of the first slot 41*b* and a first side of the second slot 41*a*, and a third element 41*g* that defines a portion of the second side of the first slot 41*b* and the second side of the second slot 41*a* that is opposite its first side defined by the second element 41*f*. The second side of the first slot 41*b* may be split via the second slot 41*a* such that the second slot 41*a* is in communication with the first slot 41*b* at the gap 41*h* between the second and third elements 41*f* and 41*g* that is defined by the second slot 41*a*. The gap 41*h* can separate the first slot 41*b* into a first portion 41*k* of the first slot 41*b* and a second portion 41*j* of the first slot 41*b*. The first and second portions 41*k* and 41*j* of the first slot 41*b* can also be considered separate apertures that are spaced apart by the second slot 41*a* and/or gap 41*h*. The thickness of the first slot 41*b* may be less than the thickness of the second slot 41*a*. For instance, the second slot 41*a* may be sufficiently thick to receive a side portion of multiple different bodies 2, while the first slot may be only sufficiently thick to receive a portion of a single body 2.

Figure 9:
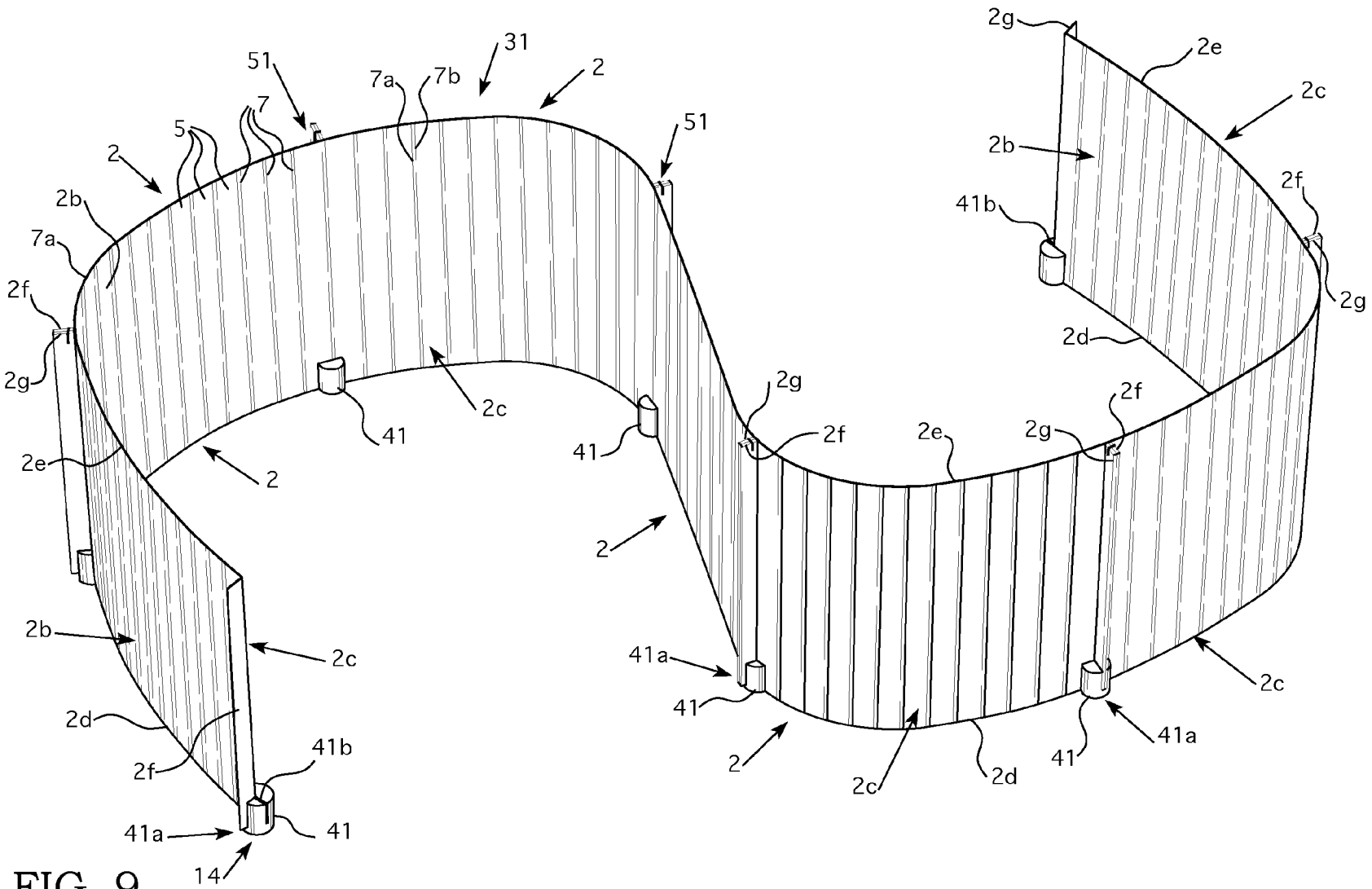
FIG. 9 is a perspective view of a third exemplary embodiment of a privacy screen apparatus.
Figure 10:
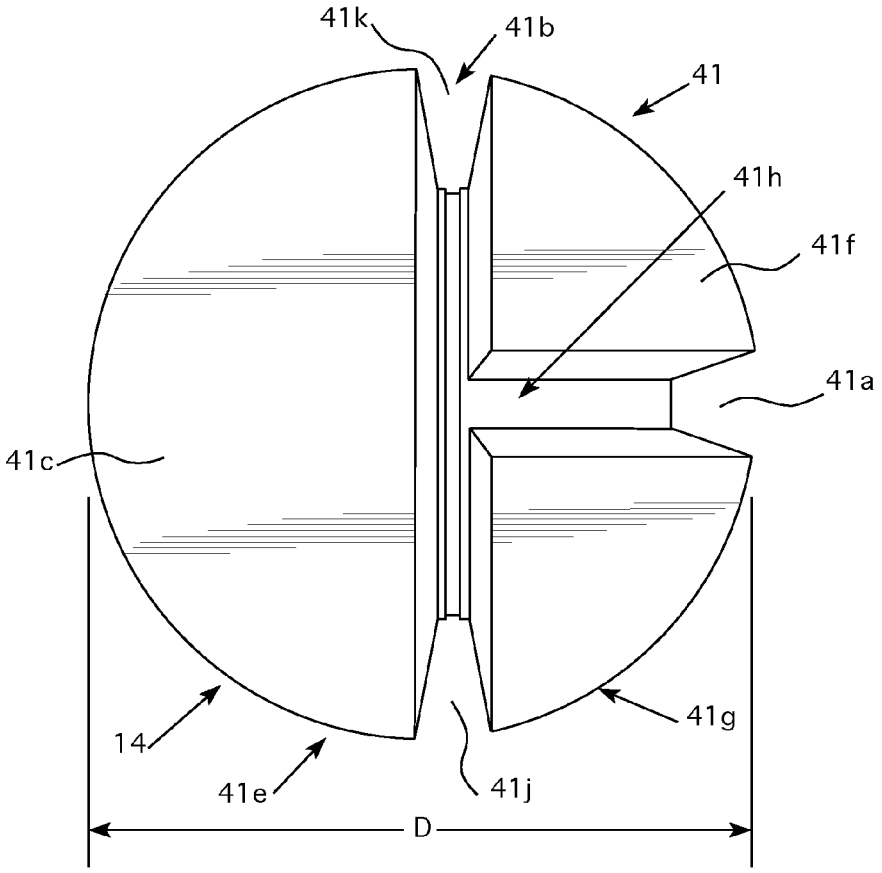
FIG. 10 is a top view of a stand element of the third exemplary embodiment of a privacy screen apparatus.
Figure 11:
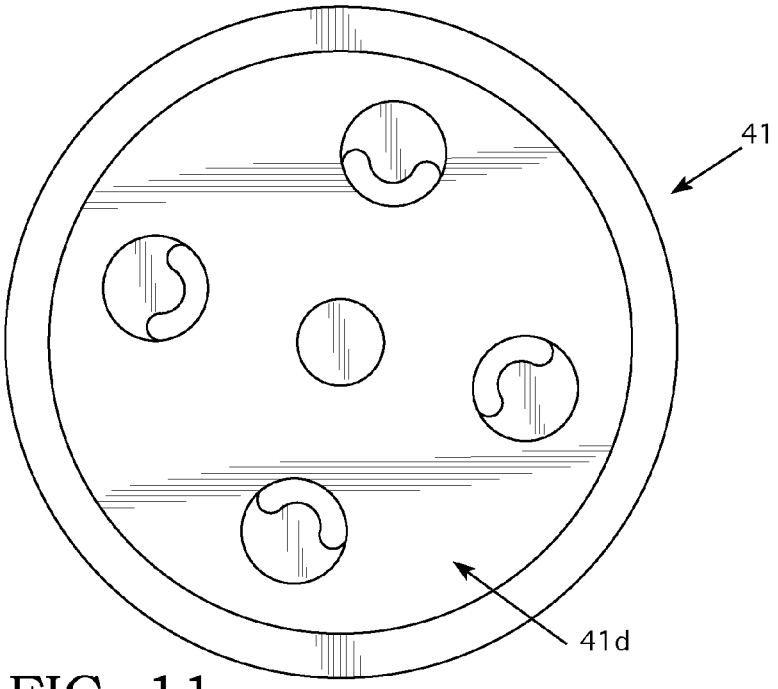
FIG. 11 is a bottom view of the stand element of the third exemplary embodiment of a privacy screen apparatus.
Figure 12:
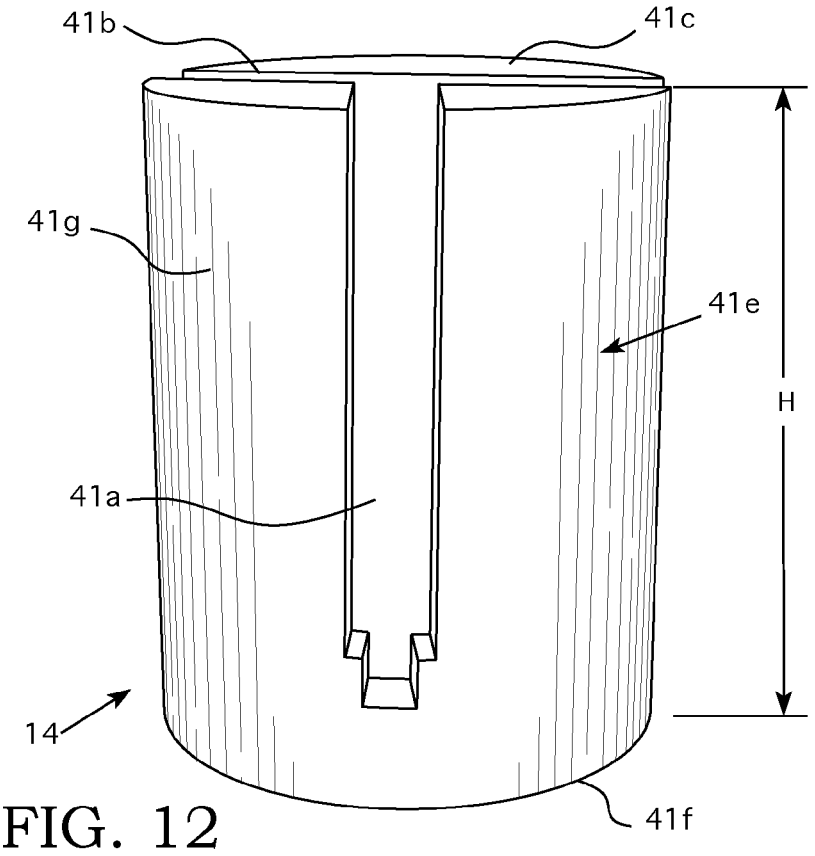
FIG. 12 is a side view of the stand element of the third exemplary embodiment of a privacy screen apparatus.
Figure 13:
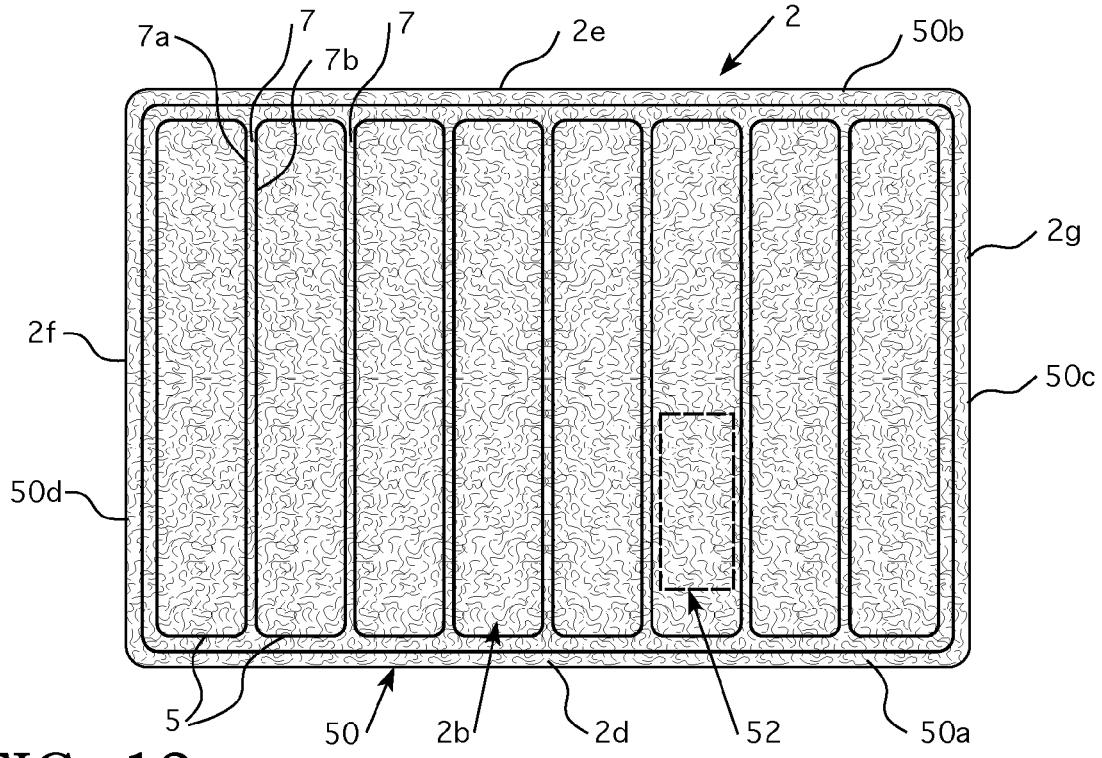
FIG. 13 is a perspective view of an exemplary embodiment of a body 2 that may be utilized in the first, second, and third embodiments of the privacy screen apparatus.

As can be seen from FIG. 9, the stand elements 41 can be configured so that a stand element 41 may connect two different bodies 2 together for forming a larger privacy screen apparatus 31 that includes multiple discrete bodies 2 that are interconnected via stand elements 41. The larger privacy screen apparatus 31 can be configured for positioning on a floor via stand elements 41. The recess regions 7 of each body and the positioning of the stand elements can provide for changeable configurations of the privacy screen apparatus 31. For instance, the privacy screen apparatus 31 can be changeable back and forth between a number of configurations, which may include all (or at least some) of the following configurations: (i) a linear extending configuration (e.g. a configuration in which the bodies 2 are arranged to extend linearly), (ii) a generally "U" shaped configuration in which the bodies 2 are arranged so that the privacy screen apparatus 31 has a generally "U" shaped orientation (e.g. the bodies are arranged so that the privacy screen apparatus 31 has the shape of a "U" in such a configuration), (iii) a generally "V" shaped configuration (e.g. the bodies 2 are arranged so that the privacy screen apparatus 31 has a "V" shape in such a configuration), (iv) a generally "C" shaped configuration (e.g. the bodies 2 are arranged so that the privacy screen apparatus 31 has a "C" shape in such a configuration), (v) a generally "S" shaped configuration (e.g. the bodies 2 are arranged so that the privacy screen apparatus 31 has a "S" shape in such a configuration), (vi) a generally "0" shaped configuration (e.g. the bodies 2 are arranged so that the privacy screen apparatus 31 has an "O" shape in such a configuration), (vii)) a generally "L" shaped configuration (e.g. the bodies 2 are arranged so that the privacy screen apparatus 31 has an "L" shape in such a configuration), and (viii) a curved configuration in which the bodies are arranged to extend along one or more curves in such a configuration.

Each body 2 can be positioned to be received in a stand element 41 so that the portion of the body is within the first slot 41*b*, within second slot 41*a*, or within both the first and second slots 41*b* and 41*a*. For instance, a bottom of the third side 2*f* of a first body 2 may be positioned so that it is located within a portion of the first slot 41*b* and in the entirety of the second slot 41*a* such that a portion the body that includes the third side 2*f* is positioned in these slots. This portion of the first body may be bent at a right angle or at almost a right angle (e.g. 90° relative to an adjacent unbent part of the body 2, 80°-90° relative to an adjacent unbent part of the body 2, 80°-100° relative to an adjacent unbent part of the body 2, etc.) The fourth side 2*g* of the first body 2 may be positioned in the first and second slots 41*a* and 41*b* of a second stand element 41. The third side 2*f* of a second body 2 can also be positioned in the first and second slots 41*a* and 41*b* of the second stand element 41. The third side 2*f* of the second body and the fourth side 2*g* of the first body can both be in contact with each other when positioned in the second slot 41*a* of the stand element and may each be in a respective portion of the first slot 41*b* so that only that body portion is in their respective portion of the first slot 41*b*. For instance, the third side 2*f* of the second body can be within the second portion 41*j* of the first slot 41*b* and also in the second slot 41*a* and the fourth side 2*g* of the first body can be within the first portion 41*k* of the first slot 41*b* and in the second slot 41*a*. The portions of the third side 2*f* of the second body and the fourth side 2*g* of the first body that are in the second slot 41*a* can be in contact with each other and side by side each other.

An upper clamping connector 51 such as a bobby pin or clothes-pin or other type of connector can also be positioned over the upper edge of the third side 2*f* of the second body and the upper edge of the fourth side 2*g* of the first body as well to provide for an attachment of the upper edges of the first and second bodies opposite the location of the stand element 41. Use of the clamping connectors can help keep the bodies straight and in alignment with each other through the length of the bodies.

It is also contemplated that foot elements may be connected to the bottom of the bodies 2 between stand elements 41. The foot elements may be positioned to help provide additional support to the body as it extends along its width between sand elements 41 to which that body 2 is connected. The foot elements may include a slot for receiving a portion of a bottom edge of the body and have a flat bottom for providing such support.

Different stand elements 41 can be positioned for connecting opposite sides of different bodies together to form larger and differently shaped privacy screen apparatuses. Further, after being connected to the bodies 2 via the bodies 2 being retained within the first and second slots 41*b* and 41*a* or only one of these slots (e.g. first slot 41*b*), the stand elements 41 can be moved to adjust the positioning of the bodies 2 on a floor to change the orientation or shape of the privacy screen apparatus 31. For instance, movement of the stand elements 41 after they are connected to bodies 2 via having those bodies received in the first and/or second slots 41*b* and 41*a* can also cause the bodies to flex about the length of a recess region 7 that is closest to the stand element and is also outside of the stand element 41 as well as other recess regions to change in configuration for orienting the privacy screen apparatus 31 between any of (i) a linear extending orientation, (ii) a generally "U" shaped orientation, (iii) a generally "V" shaped orientation, (iv) a generally "C" shaped orientation, (v) a generally "S" shaped orientation, (vi) a generally "0" shaped orientation, (vii) a generally "L" shaped orientation and (viii) a curved orientation in which the bodies are arranged to extend along one or more curves in such a configuration.

In some other embodiments, a body 2 can be connected to a work surface 15 such as a tabletop, countertop, or desktop, via a plurality of connectors 12 to form a privacy screen apparatus 11, as may be appreciated from FIGS. 3-8. Embodiments of such a privacy screen apparatus 11, can include multiple connectors 12 that may be configured to have a first portion fastened to the work surface 15 and have a second portion configured to hold a portion of the body 2 for holding the body 2 in a desired position adjacent to the work surface for providing a visible barrier to provide some level of privacy to a person or group of persons that may be using that work surface 15.

Figure 3:
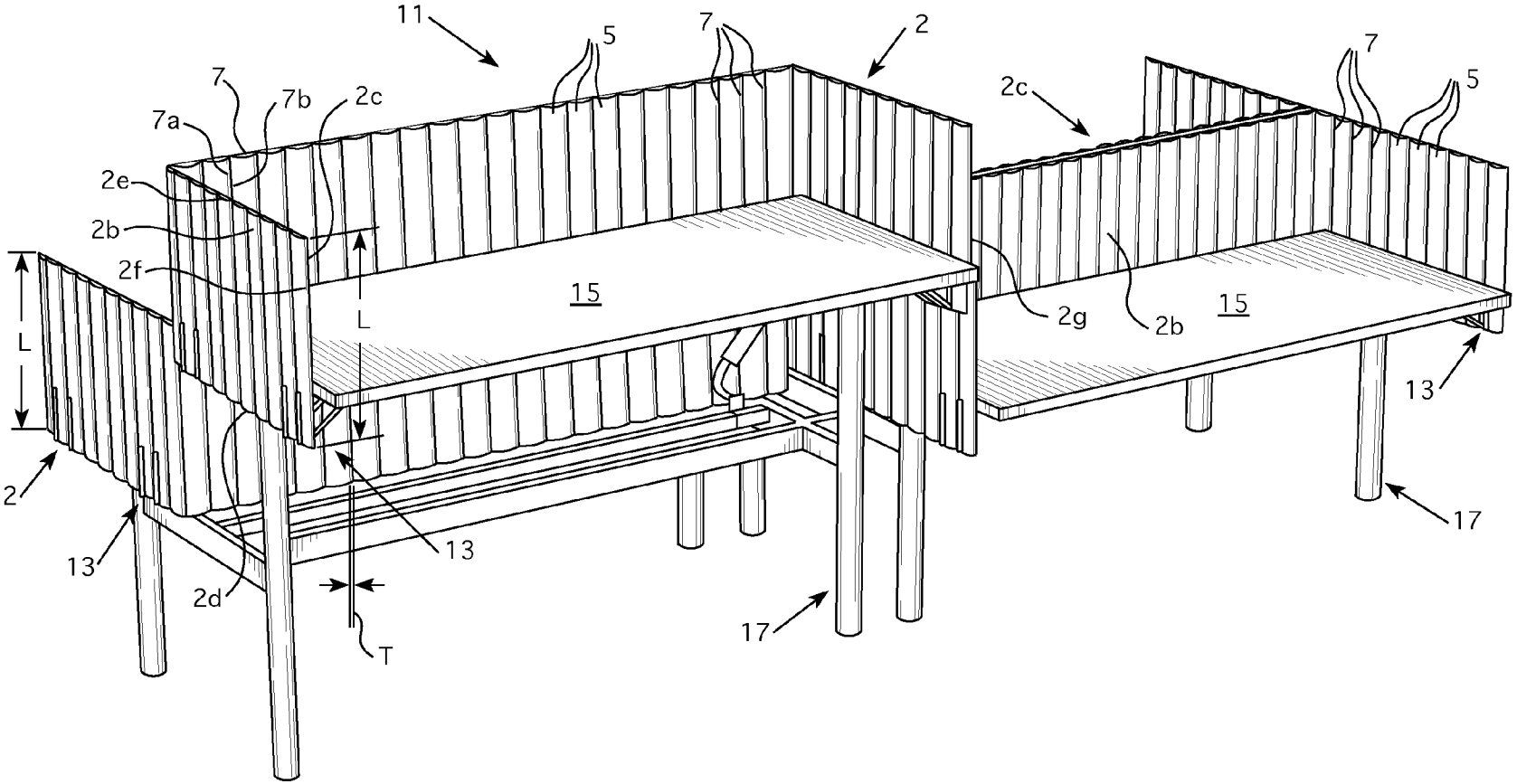
FIG. 3 is a perspective view of a second exemplary embodiment of a privacy screen apparatus.
Figure 7:
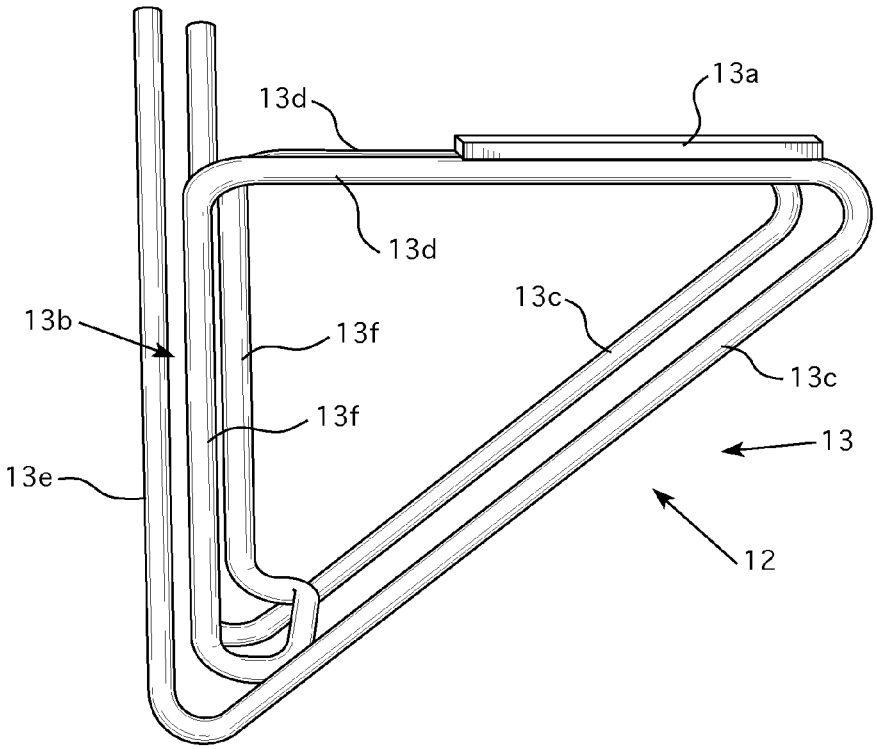
FIG. 7 is a side perspective view of a connection mechanism that is used in the second exemplary embodiment of a privacy screen apparatus.
Figure 8:
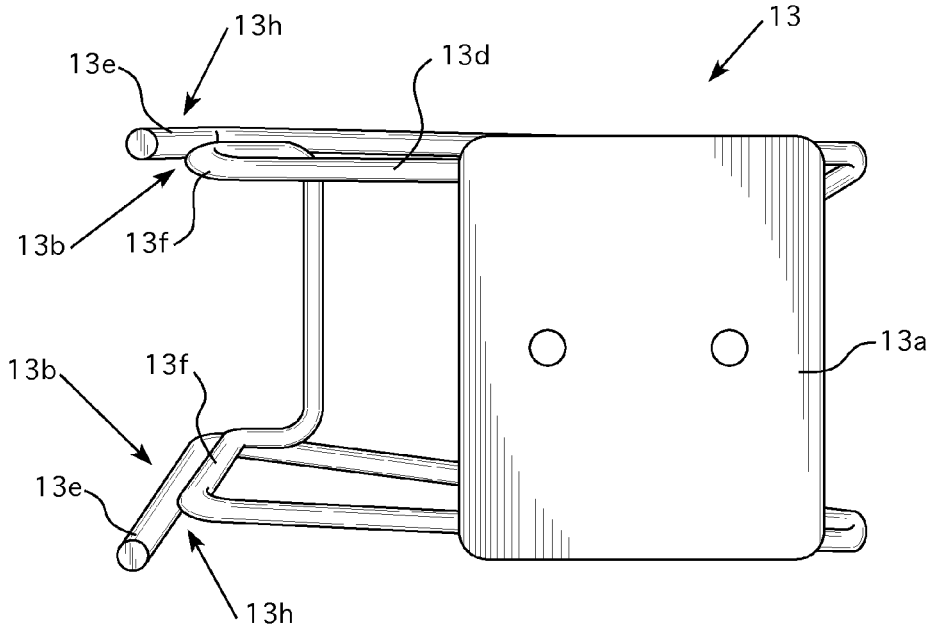
FIG. 8 is a top perspective view of the connection mechanism that is used in the second exemplary embodiment of a privacy screen apparatus.

In some embodiment, the connector 12 can be configured as a body grasping connector 13 as shown in FIGS. 3 and 7-8. In other embodiments, the connector 12 can be configured to pass through a portion of the body 2 about the thickness T of the body for attachment of the body 2 to an article of furniture that has the work surface 15 or supports the work surface 15.

Referring to FIGS. 7-8, each body grasping connector 13 can include a bracket 13*a* that may include a member having holes that are sized to receive fasteners such as bolts, screws, or nails that may be passed through the holes for attaching the bracket 13*a* to an underside of a work surface 15 (e.g. a bottom surface of a tabletop or desktop). In other embodiments, the bracket 13*a* may include a profile that is configured to matingly interlock with a profile on the structure to which it is to be attached. The bracket 13*a* may be a relatively flat member that is circular or rectangular in shape (e.g. is a plate or disk) or may be a differently shaped member. The body grasping connector 13 may include spaced apart first members 13*c* that extend from below a first side of the bracket 13*a* to a position that is below and away from the second side of the bracket that is opposite the first side of the bracket. The first members 13*c* can include upwardly extending distal end portions 13*e* that are configured to extend parallel to and spaced apart from vertically extending sections 13*f* of opposing second members 13*d* that extend from the second side of the bracket 13*a*. The spaced apart vertically extending sections 13*f* of opposing members 13*d* are spaced apart from the distal end portions 13*e* of the first members to define openings 13*b*. Each opening 13*b* is defined between a respective vertically extending section 13*f* that is spaced apart from, parallel to, and in alignment with a respective upwardly extending distal end portion 13*e* such that each opening 13*b* is defined by a corresponding set of an upwardly extending distal end portion 13*e* and a vertically extending section 13*f*.

Each opening 13*b* can include an upper mouth 13*h* that is open for receiving a portion of a body 2. The opening 13*b* can be sized to resiliently receive a lower portion of the body 2 so that a body 2 portion positioned in the opening 13*b* is grasped by the distal end portion 13*e* against the corresponding vertically extending section 13 that defines that opening 13*b*. The distal end portions 13*e* can be configured to move away from the vertically extending sections 13*f* of the second members 13*d* when a body 2 is positioned in the opening 13*b* and can be configured to be biased to try and return to their initial position in response to being moved away from the vertically extending sections 13*f* to receive the lower portion of the body 2 for grasping the body between the distal end portions 13*e* and the vertically extending sections 13*f* of the second members 13*d*. The shape, material composition, and structure of the first members 13*c* can contribute to the resiliency of the distal end portions that are biased o be moved toward the vertically extending sections 13*f* in response to the body 2 being positioned in the openings 13*b* for grasping the lower portion of a body 2 received in the openings 13*b*.

In some embodiments, the second members may be generally L shaped members and the first members may be generally "V" shaped members in which one side of the "V" is a vertical member (e.g. the distal end portion 13*e*) and the other side of the "V" shaped member extends at an angle upwardly from a lower end of the vertical member to a position adjacent to the first side of the bracket 13*a*. A lower portion of the distal end portion and a lower portion of this upwardly extending upward section can define a corner on which a lower part of the body 2 may rest.

After being inserted into openings 13*b*, the body 2 can be removed by a user pulling the body 2 out of the mouth 13*h* of the opening 13*b*. A force may be required that is sufficient to overcome the grasping force provided by the distal end portions 13*e* to cause the body 2 to be moved out of the opening 13*b* to separate the body 2 from the grasping connector 13.

Figure 4:
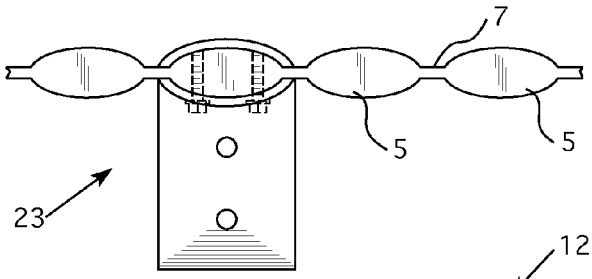
FIG. 4 is a top view of a connection mechanism that is utilizable in the second exemplary embodiment of a privacy screen apparatus.
Figure 5:
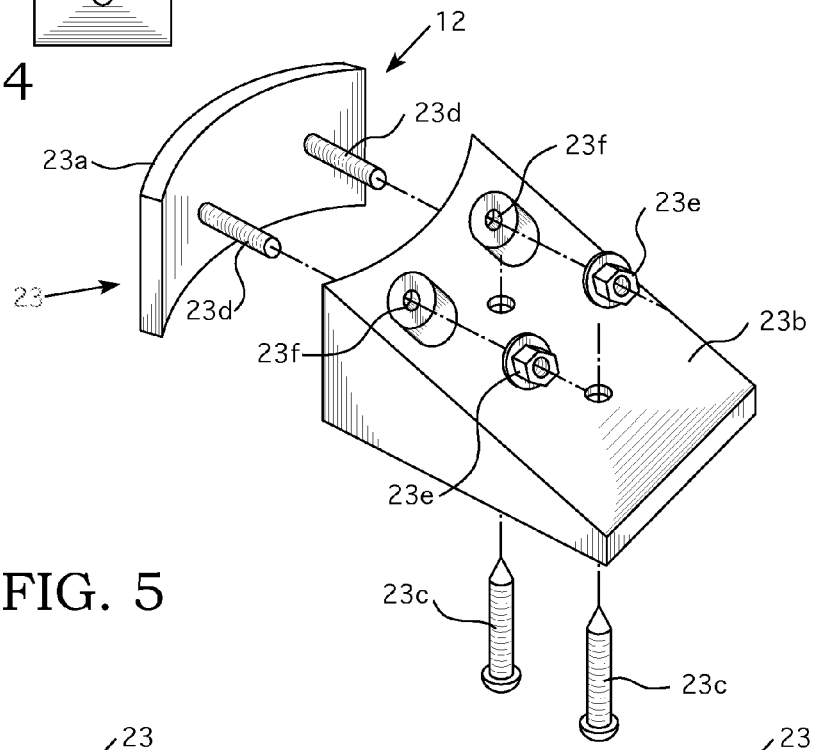
FIG. 5 is an exploded bottom view of the connection mechanism shown in FIG. 4.
Figure 6:
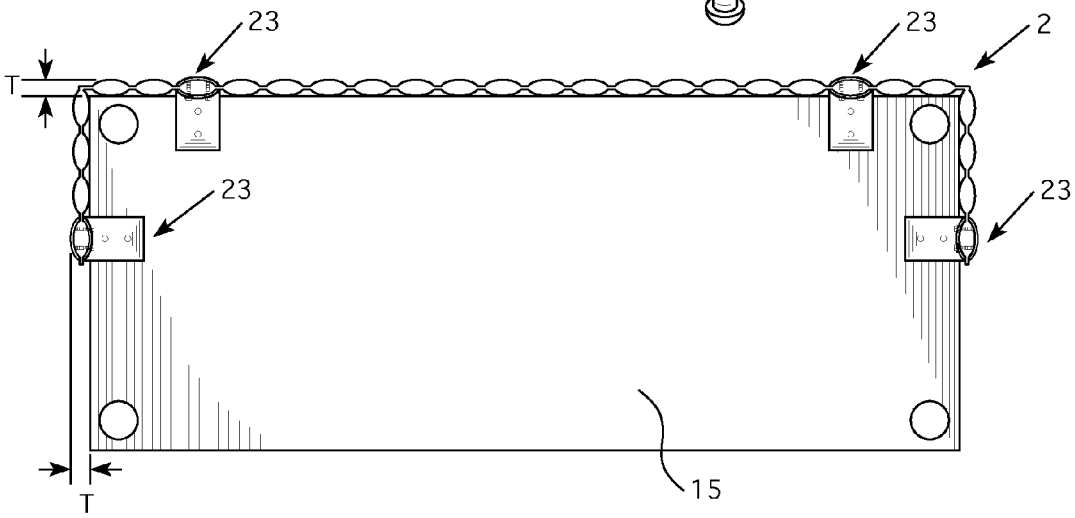
FIG. 6 is a bottom view of an exemplary embodiment of the privacy screen apparatus having the connection mechanism shown in FIGS. 4 and 5.

In other embodiments, the connector 12 can be configured as a clamping connector 23, as shown in FIGS. 4-6, for example. Each clamping connector 23 can include a work surface connecting body 23*b* that is configured to be adjustably connected to an outer clamping body 23*a*. The clamping body may be moveable toward the connecting body 23*b* for clamping or retaining a portion of the body 2 between the connecting body 23*b* and the clamping body 23*a*. The clamping body 23*a* may also be moved away from the connecting body 23*b* for releasing the body 2 from the clamping connector 23.

In some embodiments, threaded members 23*d* may extend from the clamping body 23*a* and into openings 23*f* formed in the connecting body 23*b*. Nuts or other type of connecting elements 23*e* may be rotated on the threaded members to be moved on a distal end portion of the threaded members 23*d* for adjusting the space between the clamping member 23*a* and the connecting body 23*b* (e.g. the distance between these elements). Rotation of the connecting elements 23*e* in a first direction (e.g. clockwise or counter-clockwise) can cause the elements to move along the threaded members to be closer to the clamping body 23*a* to bring the clamping body 23*a* closer to the connecting body 23*b* and rotation of the connecting elements 23*e* in a second direction that is opposite the first direction can cause the connecting elements 23*e* to move along the threaded members 23*d* in a direction that is away from the clamping body 23*b* to permit the clamping body 23*a* to be moved farther away from the connecting body 23*a*.

The threaded members 23*d* may be passed through the entirety of the thickness T of the body 2 for being received through openings 23*f* for the attachment and spacing of the clamping body 23*a* to the connecting body 23*b* and attachment or retention of the body 2 to the clamping connector 23. In some embodiments in which the body 2 is formed of an elastomeric material having a non-woven structure, the threaded members may pass through holes defined in the body 2 as they pass through the thickness T of the body.

The connecting elements 23*e* can be positioned for holding the position of the clamping body 23*a* and/or adjusting the position of the clamping body 23*a* relative to the connecting body 23*b*. The connecting body 23*b* can be fastened to an underside of the work surface of another part of an article of furniture via screws, nails, or other type of fastener 23*c* that may pass through connecting body 23*b* for attachment of the connecting body 23*b* to that article or work surface. In other embodiments, it is contemplated that the connecting body 23*b* may have a profile that is configured to matingly interlock with a profile of the article or work surface for such a connection.

In some embodiments, a single body 2 may be positioned to be wrapped about multiple sides of a work surface 15. For instance, connectors 12 can be positioned on first and second sides of a work surface and the rear side of the work surface that is between the first and second sides. The body may then be positioned for retention by the connectors so that a first side portion of the connector extends along the first side of the work surface, a second side portion of the body 2 extends along the second side of the work surface, and an intermediate portion of the body 2 that is between the first and second side portions of the body extends along the rear side of the work surface. The body 2 can be structured from foam or an elastomeric material that facilitates the bending or flexing of the body 2 that is necessary for the body to be so wrapped about multiple sides of a work surface. The bending or flexing of the body 2 can occur at the recess regions 7 adjacent the locations at which the body is to be bent to wrap about the work surface 15 via the connectors 12.

Figure 18:
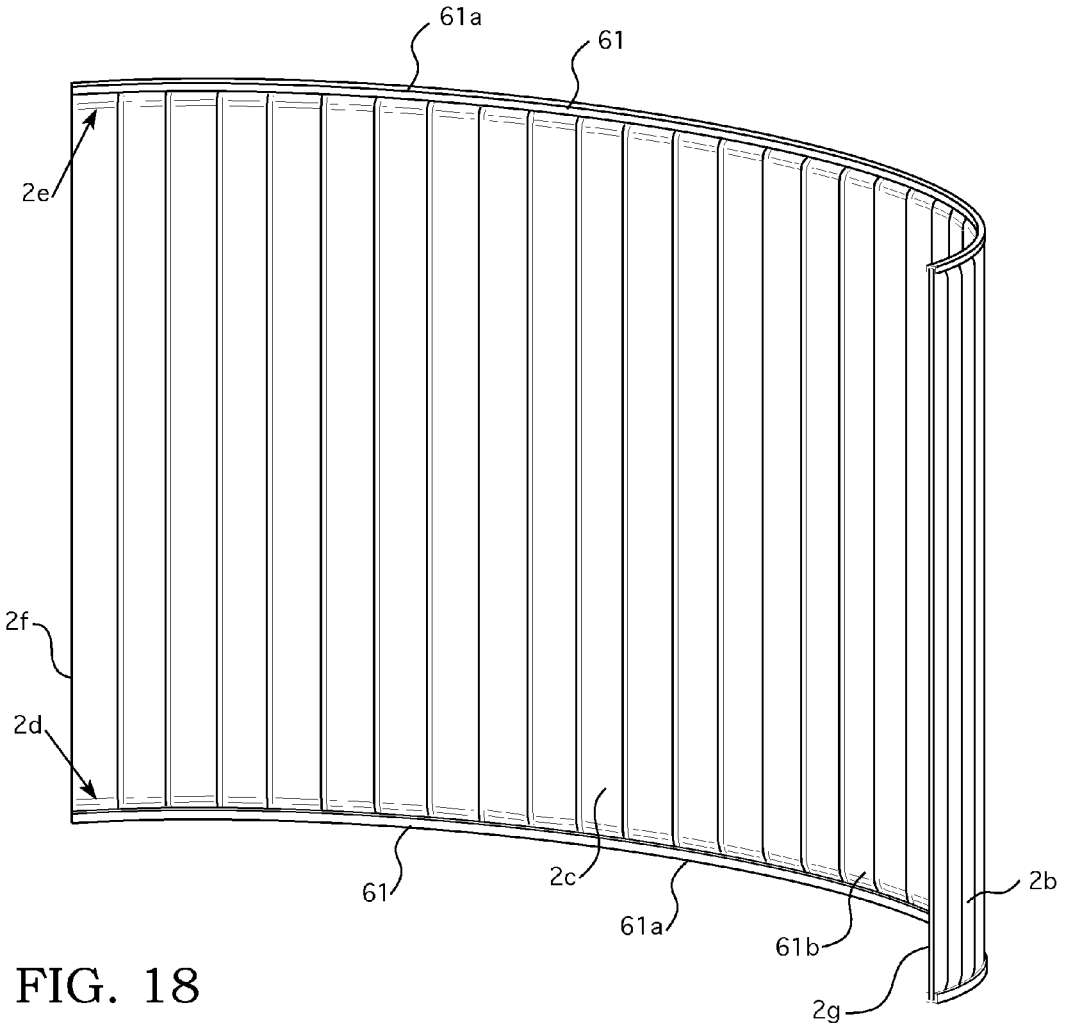
FIG. 18 is a perspective view of a fourth exemplary embodiment of a privacy screen apparatus.
Figure 19:
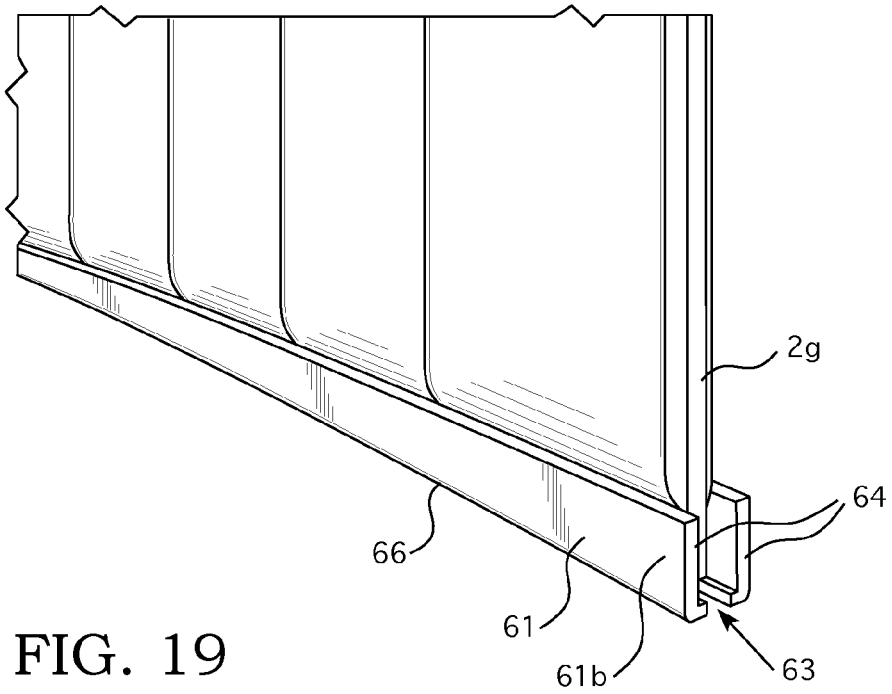
FIG. 19 is a fragmentary view of a bottom portion the fourth exemplary embodiment of the privacy screen apparatus.
Figure 20:
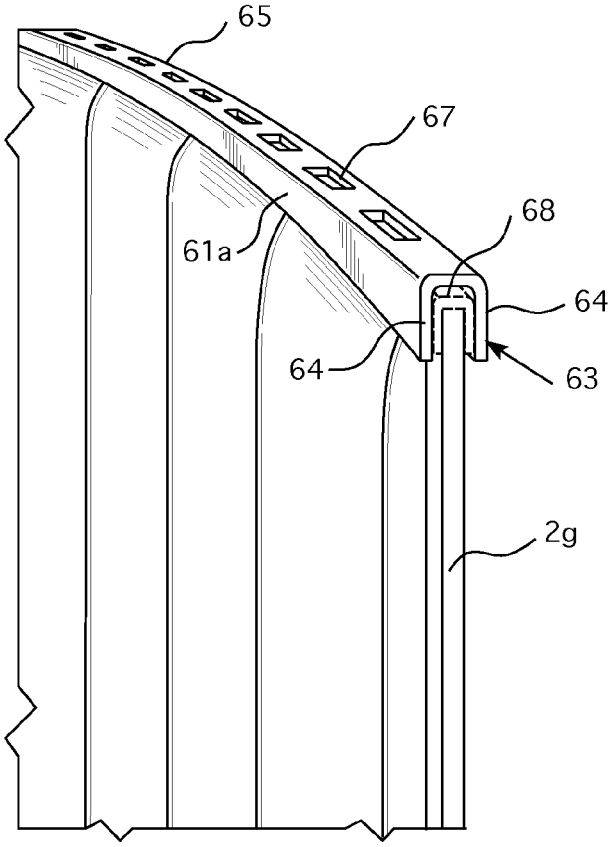
FIG. 20 is a fragmentary view of a top portion of the fourth exemplary embodiment of the privacy screen apparatus.

As can be seen from FIGS. 18-20, some embodiments of the privacy screen apparatus 1 may be configured to be directly supported on a floor or work surface or have a rail 61 or other type of stand element extend along a substantial portion of the length of the top and/or bottom of the body 2 of the privacy screen apparatus to help facilitate the free standing of the body 2 and to help define a particular shape of the body 2. For instance, an upper rail 61*a* may be connected to a top portion of the body 2 adjacent its top edge 2*e*. The upper rail 61*a* may extend along the entire length of the top edge 2*e*, extend along a substantial length of the top edge 2*e* (e.g. along 75-95% of the length of the top edge, along over 80% of the length of the top edge, etc.), or may extend along a portion of the top edge 2*e*. A lower rail 61*b* may be attached to the bottom edge 2*d* of the body 2. The lower rail may extend along the entirety of the bottom edge 2*d*, extend along a substantial length of the bottom edge 2*d* (e.g. along 75-95% of the length of the bottom edge, along over 80% of the length of the bottom edge, etc.), or may extend along a portion of the bottom edge 2*d*. Each rail may be configured to define a central slot 63 that has an open mouth sized to receive a portion of the body 2 along the edge of the body to which that rail is attached. The slot 63 may extend from adjacent a first end of the rail to adjacent its opposite second end. The slot 63 may be in communication with a plurality of holes 67 formed on a top or bottom of the rail. In other embodiments, the rail may not include any holes 67. For instance, the rail can have a solid top or bottom side that defines a portion of the slot 63 that does not include any holes 67.

The mouth of the slot 63 of the upper rail 61*a* may face downwardly opposite an upper side 65 of the rail that may have the holes 67. The upper side 65 may be an elongated member that extends between sidewalls 64 that project from the elongated member vertically and downwardly to define the slot 63 and downward facing mouth of the slot 63 in the upper rail 61*a*. The upper side of the upper rail 61*a* may be flat, or substantially flat and may have one or more holes 67 defined therein.

The lower rail 61*b* may have a slot 63 that has its open mouth face upwardly opposite a bottom side 66. The bottom side 66 may be horizontal, flat, or substantially flat (e.g. within 2° of being horizontal or flat along the length of the rail, within 5° of being horizontal or flat, etc.) elongated member. The slot 63 may be defined by spaced apart sidewalls 64 that extend vertically and upwardly from the bottom elongated member that defines the bottom side 66. The bottom side may have holes 67 similarly to the upper rail 61*a* or may not include such holes. The upper and lower rails 61*a* and 61*b* may be composed of metal or may be composed of a polymeric material or other type of material. Each of the rails may be more rigid than the body and may extend in a particular shape along its length, such as a curved shape resembling a C, U, or V or J or a linearly angled shape resembling a Z, V, M, N, or L. The rigidity of the rails can help define the shape of the body of the privacy apparatus 1 and cane help ensure that the body 2 is able to freely stand on a work surface (e.g. a floor, a desktop, a countertop, etc.).

In some embodiments, the slot 63 of each rail 61 can be sized to receive a plurality of bushing members 68 or also include spaced apart elements positioned within the slot that also have a mouth for receiving an edge of the body 2 and a channel in communication with the slot. The bushing members may be provided to help improve the tightness of fit between the edge of the body 2 and the rail 61 attached to that edge is sufficient for attachment of the rail 61 to the edge of the body 2. In some embodiments, the bushing members may be comprised of a resilient material such as an elastomeric material and have a body that has a "U" shape or a "C" shape that is sized to have an interference fit within the slot 63. Each bushing member 68 may be sized so that a plurality of such members may be positioned in the slot 63 at spaced apart locations. These spaced apart bushing members 68 may be positioned in the slot 63 of the rail 61 to help ensure a sufficient tightness of fit between an edge of the body 2 to which that rail is attached and the rail for facilitating attachment of the rail to the edge of the body. The bushing members may be separate members positionable within the slot 63 or may be integrally formed components defined within the slot 63 of the rail 61.

As may be appreciated from FIGS. 21-24, the use of upper and/or lower rails 61*a* and 61*b* can also help facilitate a structure for privacy screen apparatus that can help facilitate a structure that can be mounted on or otherwise attached to a desktop, tabletop, or countertop or other work surface 15 via one or more connectors 12. For example, a plurality of spaced apart connectors 12 can be connected to a work surface for the mounting and positioning of multiple bodies 2 to the work surface. The connectors 12 may provide an arrangement of bodies 2 that cover all but one edge of a work surface 15, only one edge of a work surface, or more than one edge of a work surface 15 to provide visual and/or sound privacy for one or more people who may use that work surface.

Figure 21:
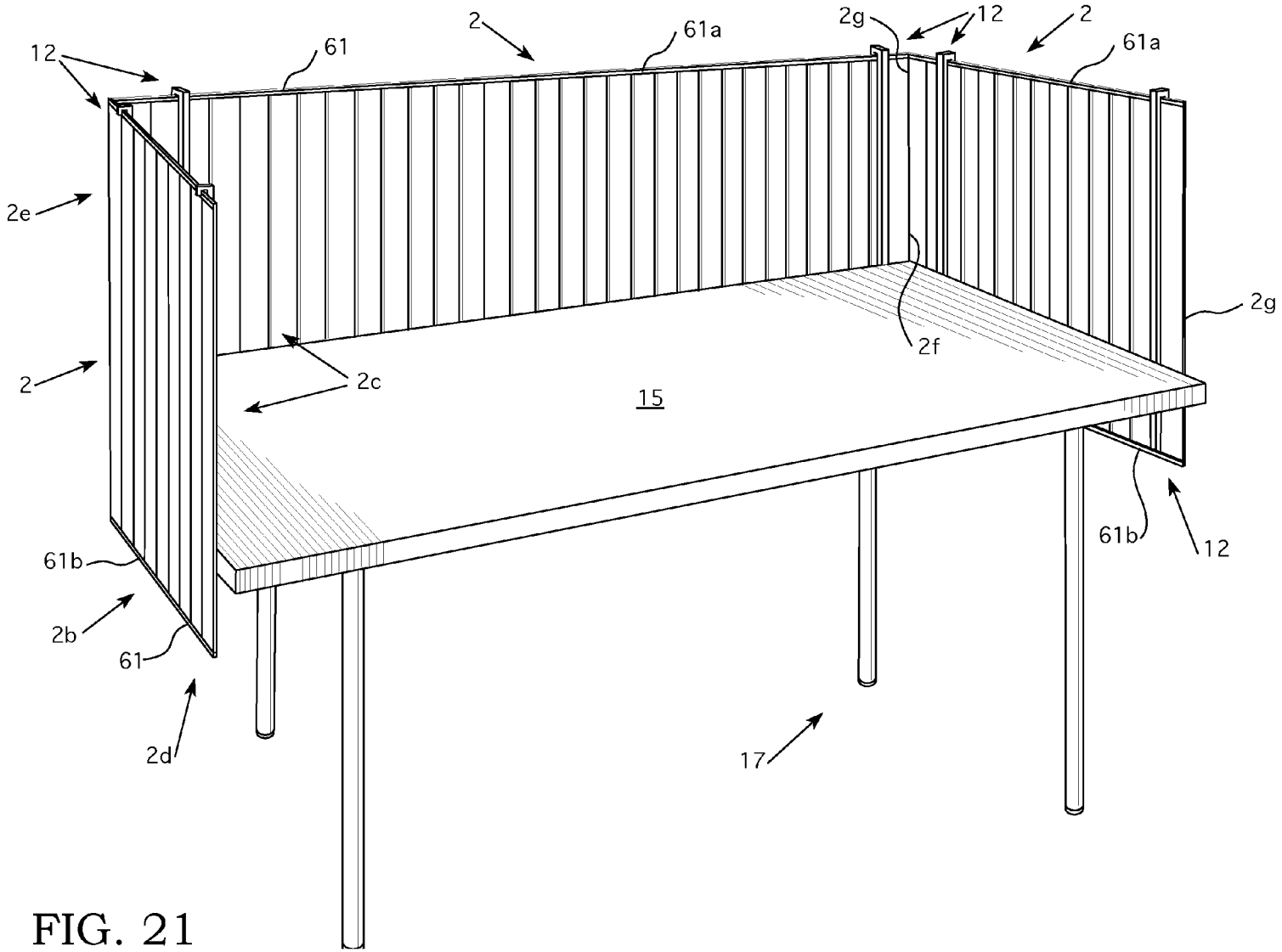
FIG. 21 is a perspective view of the fourth exemplary embodiment of the privacy screen apparatus utilizing an exemplary connector 12.
Figure 22:
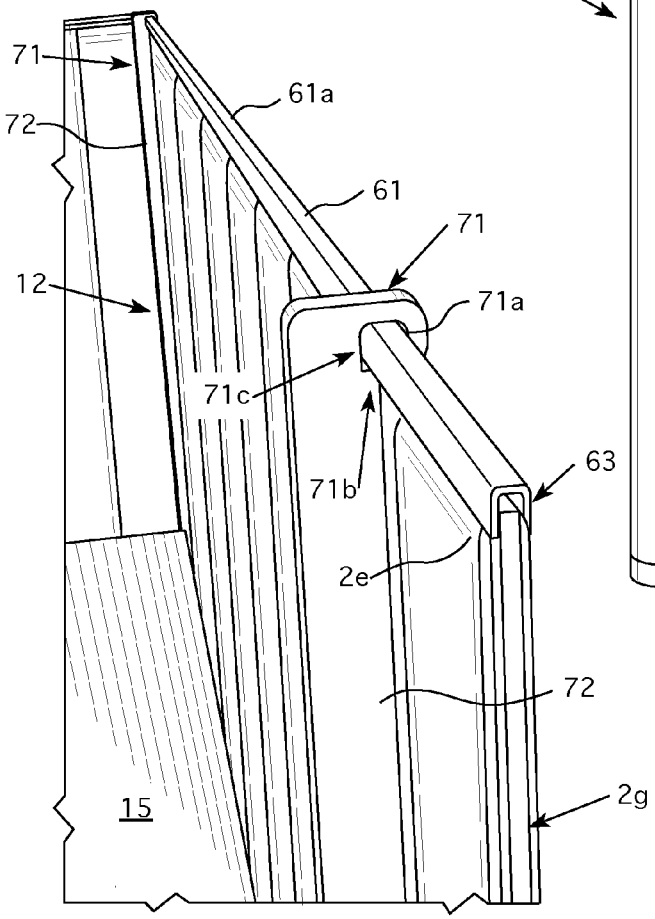
FIG. 22 is a fragmentary view of the embodiment of the privacy screen apparatus shown in FIG. 21.

As can be seen from FIGS. 21-22, the connectors 12 can be configured as hook elements 71 that are attached to the work surface 15 and have a member 72 that extends adjacent the work surface above the work surface 15 to a top portion of the body 2. The member 72 can be an elongated member that extends linearly and has an upper end 71*a* that has a hook configuration with an opening for releaseably retaining an upper rail 61*a* attached to the upper edge 2*e* of the body. The opening 71*c* of the hook end may be configured so that the opening is a full circle or polygonal shaped opening having a slit 7 lb defined therein in communication with that opening 71*c* such that the rail 61 is positionable through the opening and the upper edge 2*e* can then be passed through the slit and into the slot 63 of the rail for attachment to the connector 12 via the rail 61 and upper end 71*a* hook configuration. In other embodiments, the slit may be sized and configured such that the hook configuration is able to resiliently allow the rail 61 and upper edge 2*e* to pass through the slit and into the opening defined by the hook configuration of the upper end 71*a*. The hook configuration may resiliently narrow the slit after the rail is passed through the slit and into the opening to hold the rail 61 and to permit a portion of the body to extend from the opening through the slit. In yet other embodiments, the hook configuration may be configured to latch onto or engage a portion of the rail to hold the rail such that the upper edge of the body and the rail are within the opening and the body extends from the opening, through the slit, and to a position at or below the edge of the work surface to which the body 2 is attached via the connector 12.

Multiple spaced apart connectors 12 may have their upper ends 71*a* grasp the upper rail 61*a* at different locations to hold, or suspend, the body 2 adjacent an edge of the work surface or above the work surface to provide a visual barrier for that edge of the work surface that extends along the height of the body 2 for the length of the body that extends along the edge of the work surface. Each connector 12 may hold a different portion of the upper rail 61*a* and/or body 2 similarly to other connectors 12 having the upper end 71*a* with the hook configuration discussed herein for such embodiments to support the body to which it is attached adjacent the work surface.

Figure 23:
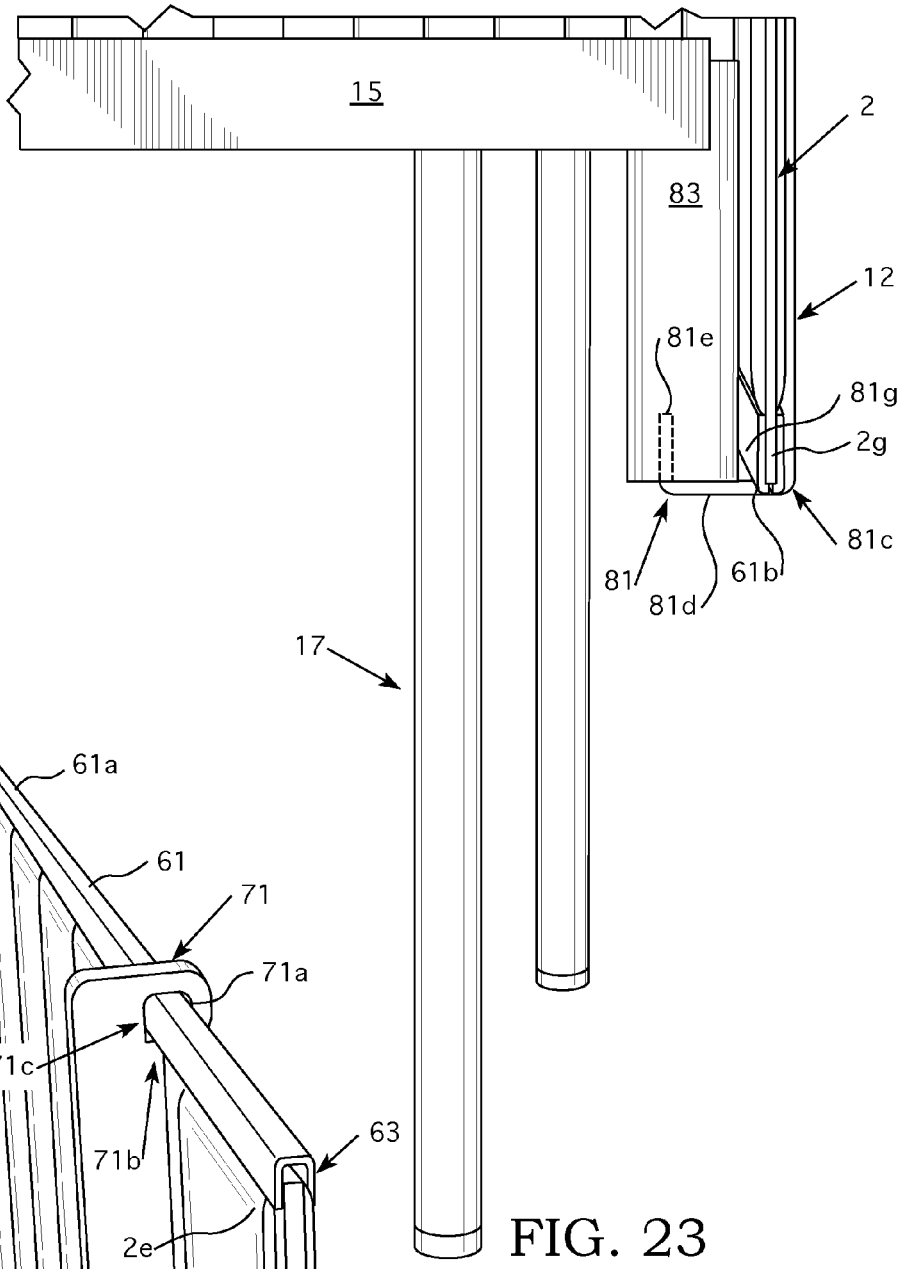
FIG. 23 is a fragmentary view of a lower side portion of the fourth embodiment of the privacy screen apparatus utilizing another exemplary connector 12.
Figure 24:
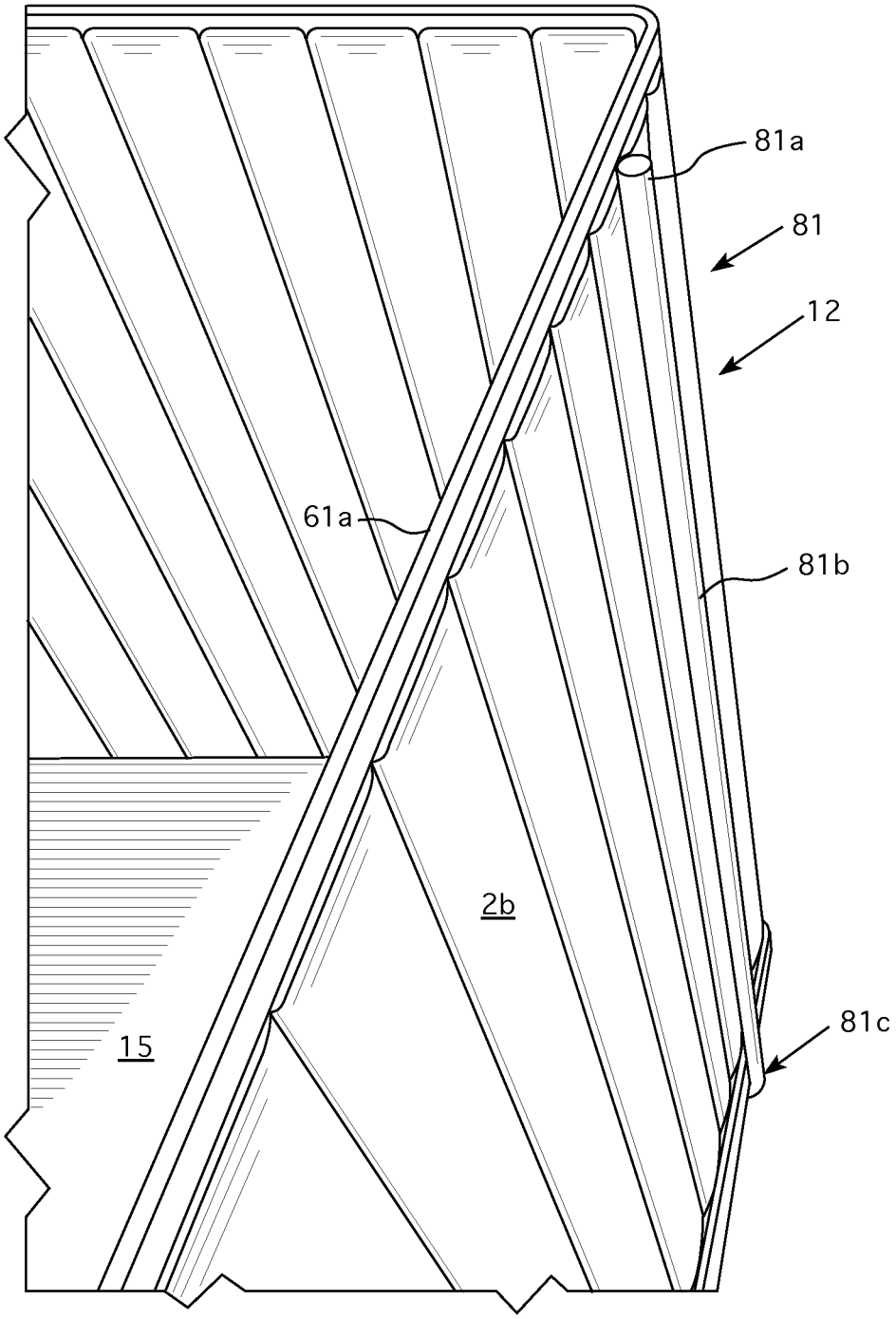
FIG. 24 is a fragmentary view of a top side portion of the fourth embodiment of the privacy screen apparatus shown in FIG. 23.

As can be seen from FIGS. 23-24, the connectors 12 could be alternatively configured to utilize a hook shaped connector body to facilitate holding one or more bodies 2 adjacent an edge of a work surface at a location adjacent a bottom of the work surface or below the work surface 15 while also having a portion of the connector above the work surface to help retain the body in its location adjacent the work surface. The connectors 12 can be configured as J-shaped members 81. Each J-shaped member may be an elongated bar, rail, tube, cylindrical shaped elongated member, polygonal shaped elongated member, or other type of elongated member that has a J-like shape. Each J-shaped member can be composed of metal, a polymeric material, or other type of material.

For instance, each of the connectors 12 can include a J shaped member 81 that has a first upper end 81*a*, a second linearly extending portion 81*b* that extends from the first upper end 81*a* to a third intermediate portion 81*c* that defines a bend between the second linearly extending portion 81*b* and a fourth linearly extending portion 81*d*. The fourth linearly extending portion extends in a direction that is perpendicular or substantially perpendicular to the second linearly extending portion 81*b* (e.g. is within 5°-10° of being perpendicular or is perpendicular). A fifth portion 81*e* extends linearly away from the fourth linearly extending portion 81*d* in a direction that is perpendicular or substantially perpendicular to the fourth linearly extending portion 81*d* and may be parallel or substantially parallel to the second linearly extending portion 81*b* (e.g. within 5°-10° of being parallel or is parallel). The fifth portion 81*e* may define another end of the J-shaped member that is the end of the J-shaped member 81 that is opposite the first upper end 81*a*. The fifth portion 81*e*, fourth linearly extending portion 81*d* and the second linearly extending portion 81*b* can be configured to define a space 81*g* between the fifth portion 81*e* and the second linearly extending portion 81*b*. A sixth portion 81*f* defining a bend between the fifth portion 81*e* and the fourth linearly extending portion 81*d* can also be included within the J-shaped member 81.

The J shaped member 81 can be connected to a bracket or other type of fastening mechanism to couple the fifth portion 81*e* to the work surface 17. For instance, a bracket assembly 83 can include a body that is configured to be coupled to an edge of a work surface and has a lower opening that is configured to receive or hold the end of the fifth portion 81*e* therein. One or more fasteners, an interlockable profile, or a lock mechanism that is adjustable between locked and unlocked positions may be included in the bracket assembly 83 for receiving and holding the fifth portion 81*e*. As yet another example, the body of the bracket assembly defining the opening for receiving the fifth portion 81*e* may be configured to resiliently hold the fifth portion 81*e* after a user manually inserts that fifth portion into the lower opening of the body of the bracket assembly without the use of a mechanical tool.

The bracket assembly 83 can be configured to hold the first portion 81*e* such that the J-shaped member extends out of the lower opening of the body of the bracket assembly that receives the fifth portion 81*e* to a location that is under the bottom edge 2*d* of the body 2 (e.g. via fourth linearly extending portion 81*d*), and extends along an outer face of the body 2 to the first upper end 81*a* (e.g. via at least first upper end portion 81*a* and second linearly extending portion 81*b*). The first upper end 81*a* may be located adjacent a middle portion of the body on its outer face that faces away from the edge of the work surface or may be adjacent a top portion of the body on its outer face. The first upper end 81*a* and the second linearly extending portion 81*b* may extend along the outer face of the body 2 and may be in contact with the outer face of the body 2 while the fourth linearly extending portion is in contact with the bottom edge 2*d* or a rail 61 attached to the bottom edge 2*d* to help retain the body 2 within the pace 81*g* so that the body is held in a location adjacent an edge of the work surface to which the bracket assembly 83 is attached.

Multiple spaced apart connectors 12 having J-shaped members 81 can be positioned along one or more edges of a work surface via bracket assemblies 83 or other fastening mechanisms to hold one or more bodies adjacent one or more edges of a work surface 15. Each J-shaped member can be configured to hold the one or more bodies at different locations to hold, or suspend, the body 2 to which it is holding adjacent an edge of the work surface to provide a visual barrier for that edge of the work surface that extends along the height of the body 2 for the length of the body that extends along the edge of the work surface. Each connector 12 may hold a different portion of a body 2 similarly to other connectors 12 having a J-shaped member 81 discussed herein for such embodiments to support the body to which it is attached adjacent the work surface.

It should be understood that modification to the privacy screen apparatuses can be made to meet a particular set of design criteria. For instance, the size, shape and weight of the body 2 can be any size or shape to meet a particular set of design criteria. As another example, the size and shape of the pillow regions 5 and recess regions 7 may be any suitable size and shape for meeting a particular set of design criteria and/or to provide a desired aesthetic effect. As another example, the type of covering 2*a*, the use of a covering 2*a*, and/or the extent to which a covering 2*a* may cover an exterior surface of a body can be adjusted as needed to meet particular design criteria and/or to provide a desired aesthetic effect. As yet another example, the type of connector 12 or stand element 14 that is utilized in an embodiment of the privacy screen apparatus may be any type of stand or connector design that is required to meet a particular set of design criteria.

Therefore, while certain exemplary embodiments of privacy screen apparatuses, connection mechanisms for privacy screen apparatuses and methods of making and using the same have been discussed and illustrated herein, it is to be distinctly understood that the invention is not limited thereto but may be otherwise variously embodied and practiced within the scope of the following claims.

What is claimed is:

1. A privacy screen apparatus comprising:

a first body that is configured to be attached to an article of furniture adjacent to a work surface, the first body having a plurality of spaced apart pillow regions and a plurality of spaced apart recess regions, each recess region spacing apart immediately adjacent pillow regions, the pillow regions having a thickness that is greater than a thickness of the recess regions; and a plurality of connectors, each of the connectors configured to attach the body adjacent to an edge of the work surface, each of the connectors comprising:

an elongated member that is configured to extend linearly from adjacent the edge of the work surface to adjacent a top edge of the first body, an upper end of the elongated member having an opening that is in communication with a slit to receive and retain the top edge of the first body within the opening such that a portion of the first body extends downwardly from the opening and through the slit;

a first rail having a slot, the top edge of the first body being received within the slot such that the first rail extends along a length of the top edge of the first body such that the first rail extends along over 80% of the length of the top edge of the first body; and wherein the first rail is within the opening of the elongated member.

2. The privacy screen apparatus of claim 1, wherein the first body is comprised of an elastomeric material and is formed to have a non-woven appearance.

3. The privacy screen apparatus of claim 1, wherein: the first body is comprised of an elastomeric material and is formed to have a non-woven appearance; and wherein the first body is formed by a plurality of elongated elastomeric fibers being bonded together to provide the non-woven appearance.

4. The privacy screen apparatus of claim 1, wherein: the first body is formed by a plurality of elongated elastomeric fibers wherein diameters of the elongated elastomeric fibers are between 0.40 mm and 0.70 mm and the elongated elastomeric fibers are bonded together such that the first body has a density of material of between 0.055 grams/cm$^3$ and 0.090 grams/cm$^3$.

5. The privacy screen apparatus of claim 1, wherein the work surface is a countertop, a desktop, or a tabletop; the elongated member is a portion of a J-shaped member and wherein:

the J-shaped member having a first upper end that is positionable adjacent an outer face of the first body to contact the first body and a second end opposite the first upper end that is positionable within a lower opening of a bracket assembly for attachment to the work surface, the elongated member being the first upper end of the J-shaped member.

6. The privacy screen apparatus of claim 1, wherein the elongated member is a portion of a J-shaped member.

7. The privacy screen apparatus of claim 1, wherein the first body is configurable to multiple different orientations via bending or flexing of the first body along at least some of the recess regions, the pillow regions being stiffer than the recess regions; and wherein the orientations of the first body comprise at least two of: a generally "U" shaped orientation, or a generally "C" shaped orientation, or a generally "S" shaped orientation, or a generally "O" shaped orientation.

8. The privacy screen apparatus of claim 7, wherein the orientations of the first body comprise all of: a linearly extending orientation, the generally "U" shaped orientation, a generally "V" shaped orientation, the generally "C" shaped orientation, the generally "S" shaped orientation, the generally "O" shaped orientation, and a generally "L" shaped orientation.

9. The privacy screen apparatus of claim 1, wherein: the first body is formed by a plurality of elongated elastomeric fibers being bonded together such that the first body has a density of material of between 0.055 grams/cm$^3$ and 0.090 grams/cm$^3$.

10. The privacy screen apparatus of claim 9, wherein the first body is formed by the plurality of elongated elastomeric fibers being bonded together such that diameters of the elongated elastomeric fibers are between 0.40 mm and 0.70 mm.

11. The privacy screen apparatus of claim 1, wherein: the first body is formed by a plurality of elongated elastomeric fibers being bonded together such that diameters of the elongated elastomeric fibers are between 0.40 mm and 0.70 mm.

12. The privacy screen apparatus of claim 1, wherein:

the opening of the elongated member releasably retains the first rail.

13. The privacy screen apparatus of claim 12, wherein a portion of the first body extends from the first rail through the slit.

14. The privacy screen apparatus of claim 13, wherein a top of the elongated member defines a hook element that is configured such that the first rail is passable through the slit and into the opening defined by the hook element and the slit is defined by the hook element such that the slit is narrowable via resiliency of the hook element after the first rail is passed through the slit and into the opening to hold the first rail within the opening.

15. The privacy screen apparatus of claim 14, wherein the hook element is configured such that the opening and the slit are positioned above the work surface.

16. The privacy screen apparatus of claim 15, comprising:

a covering that covers the first body; and wherein the first body is comprised of a foam.

17. The privacy screen apparatus of claim 16, wherein the covering is comprised of a film that covers an entirety of the first body.

* * * * *